United States Patent [19]

Takahashi et al.

[11] Patent Number: 4,983,507

[45] Date of Patent: Jan. 8, 1991

[54] SILVER HALIDE COLOR PHOTOGRAPHIC MATERIALS

[75] Inventors: Osamu Takahashi; Hideaki Naruse; Masakazu Morigaki; Nobutaka Ohki; Nobuo Furutachi, all of Minami Ashigara, Japan

[73] Assignee: Fuji Photo Film Co., Ltd., Kanagawa, Japan

[21] Appl. No.: 262,603

[22] Filed: Oct. 26, 1988

Related U.S. Application Data

[62] Division of Ser. No. 945,645, Dec. 23, 1986, abandoned.

[30] Foreign Application Priority Data

| | | | |
|---|---|---|---|
| Dec. 25, 1985 | [JP] | Japan | 60-295466 |
| Feb. 5, 1986 | [JP] | Japan | 61-23467 |
| Sep. 4, 1986 | [JP] | Japan | 61-208535 |

[51] Int. Cl.[5] ..... G03C 7/384; G03C 7/392

[52] U.S. Cl. ..... 430/551; 430/546; 430/555; 430/567

[58] Field of Search ..... 430/555, 551, 546, 567

[56] References Cited

U.S. PATENT DOCUMENTS

| | | |
|---|---|---|
| 3,726,686 | 4/1973 | Kuwabara et al. . |
| 4,310,623 | 1/1982 | Watanabe et al. . |
| 4,383,027 | 5/1983 | Ishikawa et al. . |
| 4,434,226 | 2/1984 | Wilgus et al. . |
| 4,540,657 | 9/1985 | Krishnamurthy . |
| 4,547,458 | 10/1985 | Iijima et al. . |
| 4,576,910 | 3/1986 | Hirano et al. . |
| 4,639,413 | 1/1987 | Kawagishi et al. . |
| 4,659,652 | 4/1987 | Kawagishi et al. . |

FOREIGN PATENT DOCUMENTS

| | | |
|---|---|---|
| 133131 | 10/1979 | Japan . |
| 104641 | 6/1984 | Japan . |

OTHER PUBLICATIONS

English Abstract of Japanese Patent Application 57-40245.

*Primary Examiner*—Paul R. Michl
*Assistant Examiner*—Mark R. Buscher
*Attorney, Agent, or Firm*—Birch, Stewart, Kolasch & Birch

[57] ABSTRACT

The present invention provides silver halide color photographic materials having a layer which contains at least one magenta color image-forming oleophilic coupler of the following formulae (I) and/or (II) and at least one of the following formula (III):

(I)

in which Ar represents a phenyl group which is substituted by at least one substituent selected from the group consisting of a halogen atom, an alkyl group, an alkoxy group, an alkoxycarbonyl group and a cyano group; Y represents an acylamino group or an anilino group; and $Z_1$ represents a group capable of being removed by coupling, (II)

in which X represents a hydrogen atom or a substituent;
$Z_2$ represents a hydrogen atom or a group capable of being removed by coupling;
W represents a hydrogen atom, an acyl group or an aliphatic or aromatic sulfonyl group;
Za and Zb each represent a methine group, a substituted methine group or —N=; and
X, $Z_2$ or the substituted methine of Za or Zb may form a dimer or higher polymer, (III)

in which A represents an alkyl group, an aryl group, a heterocyclic group, an acyl group, an alkoxy group, an aryloxy group, a heterocyclic oxy group, an alkylthio group, an arylthio group or an amino group, which may be substituted or unsubstituted; $R_1$ and $R_2$ each independently represents a hydrogen atom or a substituted or unsubstituted alkyl group; $R_{3a}$ and $R_{3b}$ each represents a hydrogen atom, an alkyl group, an aryl group, an alkoxy group, an aryloxy group, an alkylthio group or an arylthio group; $R_4$ represents an alkyl group, an aryl group or a heterocyclic group; and D represents an oxygen atom or a sulfur atom.

The use of the combination of the magenta coupler(s) of the formulae (I) and/or (II) and the stain-inhibitory additive(s) of the formula (II) provides photographic light-sensitive materials that are almost free from stains when such materials are preserved for a long period of time after having been exposed, developed and then photographically processed.

15 Claims, No Drawings

SILVER HALIDE COLOR PHOTOGRAPHIC MATERIALS

This is a division of application Ser. No. 945,645, filed on Dec. 23, 1986, now abandoned.

FIELD OF THE INVENTION

The present invention relates to silver halide color photographic materials containing magenta color image-forming coupler(s) and, more precisely, to a method for the prevention of the stain which will occur in the development of the photographic materials containing magenta color image-forming coupler(s). (The magenta color image-forming coupler is hereinafter referred to as a "magenta coupler" in short.)

BACKGROUND OF THE INVENTION

Magenta couplers are known to include 5-pyrazolones, indazolones, cyanoacetyls, chromans, pyrazoloazoles, etc. In particular, the skeletons of 5-pyrazolones and pyrazoloazoles among these couplers have been studied widely since the magenta colors formed therefrom have excellent absorption characteristics and high color image fastness and are highly practicable.

Among these 5-pyrazolones and pyrazoloazoles, those which are unsubstituted in the coupling position, or so-called 4-equivalent 5-pyrazolone couplers, have a specifically low coloring efficiency of 40 to 50%, the efficiency meaning the proportion of the molar amount of the dye as formed from 1 mol of the coupler. This means that double the molar amount or more of the coupler is required in order to obtain an equimolar amount of the dye therefrom, as compared with yellow, cyan or other couplers, and that large amounts of silver halides are also required. For of this reason, the proposal of so-called 2-equivalent couplers where a group capable of being removed as an anion is introduced into the coupling active position of the 5-pyrazolone skeleton has been developed. This is because the coloring efficiency is improved up to 80 to 90% and the amount of the silver halide to be used is reduced by the introduction of the group which can be removed as an anion into the coupler. On these grounds, magenta couplers which are expected to be used in color photographic materials in view of the characteristic thereof and of the economical aspect are said to be 2-equivalent 5-pyrazolone couplers having an anion-removing group and pyrazoloazoles.

Regarding the 2-equivalent 5-pyrazolone couplers, examples of oxygen atom-removing couplers are described in U.S. Pat. Nos. 3,311,476, 3,419,391 and 4,146,396; examples of nitrogen atom-removing couplers are described in U.S. Pat. Nos. 4,367,282, 4,076,533 and 4,241,168; and examples of sulfur atom-removing couplers are described in U.S. Pat. Nos. 3,227,554, 4,407,936, 4,264,723 and 4,351,897. Regarding pyrazoloazole type couplers, examples thereof are described in U.S. Pat. Nos. 3,369,897, 3,725,067, 4,500,630 and 4,540,654 and Japanese Patent Application (OPI) Nos. 33552/85 and 43659/85 (the term "OPI" as used herein refers to a "published unexamined Japanese patent application").

In silver halide color photographs, the occurrence of stains in the non-exposed parts is unfavorable, as whitening the color images, increasing the color turbidity thereof and deteriorating the visual sharpness thereof. Especially in the case of reflective materials (such as color papers), the reflected density of the stain is theoretically augmented to several times of the transmitted density and, therefore, even a weak stain is an extremely important factor in deteriorating the image quality.

The occurrence of the stains in the silver halide color photographs is principally classified into four types from the reasons thereof, as follows: The first results from the heat or moisture as imparted to the non-processed materials during the preservation thereof from the manufacture to the photographic treatment; the second results from the development fog of silver halides; the third results from the color stains of color couplers with development processing solutions (for example, aerial fog, etc.) or from the dyes as formed by the oxidation of the developing agents remaining in the emulsion fills with oxygen in the bleaching bath or in air followed by the reaction of the thus oxidized product with couplers (for example, bleaching stain); and the fourth results from the variation of the photographic materials themselves, when exposed to light, moisture or heat after having been developed with the lapse of time. The stains resulting from the development of the 2-equivalent 5-pyrazolone couplers in the present invention are the third and fourth stains.

The development of color photographic materials has another difficult problem in that the development processing solution is not freshly prepared, in general, in every development processing step except in some unusual cases but, in practice, a development replenisher is added to the processing tank in accordance with the amount of the developer solution as used in each step. However, it is impossible to keep the composition of the processing solution constant only by supplementing the water lost in the development process.

More precisely, the development processing solutions comprise, in general, a color developer solution, a stopping solution, a bleaching solution or a bleaching-fixation solution (or a so-called blix solution), and these are used at a high treating temperature of 31° C. to 43° C. in the respective processing steps, whereupon the compositions of these processing solutions vary because the developing agent decomposes or is oxidized with air after being used for a long period of time, or the components as dissolved out from the photographic materials while being processed accumulate in the processing solutions, or the processing solutions as adhered to the photographic materials which are being processed are brought into the next bath together with the materials. In other words, the processing solutions in the actual processing of photographic materials are so-called running solutions. Under this situation, the replenishment of the shortage of the chemical agents or the recovery for the removal of any waste materials from the processing solutions is carried out in practice. However, this procedure is not sufficient.

In particular, stains occur very often in the photographic light-sensitive materials containing 2-equivalent 5-pyrazolone couplers or pyrazoloazole type couplers when processed with such running solutions, and the prevention of the occurrence of these stains by conventional technical means has been insufficient up to the present.

More precisely, in order to prevent such stains, a method has been known to be effective, where an alkyl hydroquinone (for example, as described in U.S. Pat. Nos. 3,935,016 and 3,960,570) is incorporated in a photographic material, especially in the emulsion layer thereof where the stain will occur. In addition, chromans and coumarans. (e.g., as described in U.S. Pat. No. 2,360,290) and phenols (e.g., as described in Japanese Patent Application (OPI) No. 9449/76) are said to be effective in this way.

Further, U.S. Pat. Nos. 4,463,085 and 4,483,918 and Japanese Patent Application (OPI) Nos. 218445/84 and 229557/84 have proposed the effectiveness of certain kinds of amine compounds in this regard. However, all of these conventional compounds are still insufficient for attaining the object of the present invention.

Under the circumstances, the first object of the present invention is to prevent the stains which occur in the development of photographic light-sensitive materials containing a 2-equivalent pyrazolone coupler and/or a pyrazoloazole type coupler, and especially to completely prevent the stains which occur in the development thereof with a development processing solution in a running state.

The second object of the present invention is to provide photographic light-sensitive materials which contain a 2-equivalent pyrazolone coupler and/or a pyrazoloazole type coupler and a small amount of silver and which have a high sharpness and a good developability.

It is to be noted that Japanese Patent Application (OPI) No. 211147/82 describes the use of 3-pyrazolidone derivatives for the prevention of stains. These 3-pyrazolidone compounds are, however, quite different from the compounds to be used in the present invention, since they have a substituent on the 2nitrogen atom.

In this connection, the incorporation of a 3-pyrazolidone derivatives, especially the precursor thereof, in silver halide photographic materials is claimed in some patents. For instance, U.S. Pat. No. 3,241,967 claims the use of 2-(substituted methyl)-3-pyrazolidones, which are, however, quite different from the compounds as used in the present invention. The pyrazolidones have neither the object nor the effect of the present invention. Japanese Patent Application (OPI) Nos. 40245/82 and 104641/84 describe 3-pyrazolidone precursor compounds where the 3-enol is protected with an acyl ester or carbonate ester. In these publications, however, the object for the addition of the compounds to silver halide photographic materials is to impart good photographic sensitivity, maximum density and desired sensitometry characteristics to the materials, and the technical means as illustrated in Japanese Patent Application (OPI) No. 40245/82 is one to be adopted to black-and-white photographic materials. On the other hand, the technical means as illustrated in the above-mentioned Japanese Patent Application (OPI) No. 104641/84 is to attain high sensitivity of the photographic materials without the increment of the fog density thereof. Thus, the object of this technical means is different from that of the present invention, although the technical scope of this publication includes the case of color photographic materials. Further, this publication describes only 4-equivalent 5-pyrazolone couplers, and the object of the use of these couplers is different from the object of the present invention where 2-equivalent 5-pyrazolones are used.

Japanese Patent Application (OPI) No. 85749/81 describes the use of nondiffusible 1-phenyl-3-pyrazolidones in order to improve the stability of 4-alkylthio-5-pyrazolone type couplers, which is, however, different from the object of the present invention. In addition, the use of such nondiffusible pyrazolidone compounds could not attain the object of the present invention.

SUMMARY OF THE INVENTION

In order to attain the above-mentioned objects, the present inventors have found that the use of at least one magenta color image-forming oleophilic coupler of the following formula (I) and/or formula (II) together with at least one compound of the following formula (III) is effective for preventing stains as discussed hereinabove. Accordingly, the present invention is directed to silver halide color photographic materials characterized by having a layer which contains at least one magenta color image-forming oleophilic coupler of the following formula (I) and/or formula (II) and at least one compound of the following formula (III):

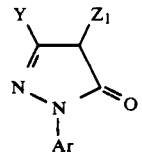

(I)

in which Ar represents a phenyl group substituted by at least one member selected from a halogen atom, an alkyl group, an alkoxy group, an alkoxycarbonyl group and a cyano group; Y represents an acylamino group or an anilino group; and $Z_1$ represents a coupling-removing group;

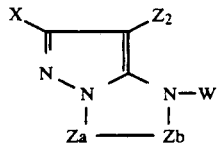

(II)

in which X represents a hydrogen atom or a substituent; $Z_2$ represents a hydrogen atom or a coupling-removing group; W represents a hydrogen atom, an acyl group or an aliphatic or aromatic sulfonyl group; Za and Zb each represent a methine group, a substituted methine group or —N=; and X, $Z_2$ or the substituted methine of Za or Zb may form a dimer or higher polymer;

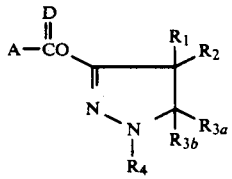

(III)

in which A represents an alkyl group, an aryl group, a heterocyclic group, an acyl group, an alkoxy group, an aryloxy group, a heterocyclic oxy group, an alkylthio group, an arylthio group or an amino group, which may be substituted or unsubstituted; $R_1$ and $R_2$ each independently represents a hydrogen atom or a substituted or unsubstituted alkyl group; $R_{3a}$ and $R_{3b}$ each represents a hydrogen atom, an alkyl group, an aryl group, an alkoxy group, an aryloxy group, an alkylthio group or an arylthio group; $R_4$ represents an alkyl group, an aryl group or a heterocyclic group; and D represents an oxygen atom or a sulfur atom.

DETAILED DESCRIPTION OF THE INVENTION

2-Equivalent 5-pyrazolone oleophilic couplers as represented by the formula (I) are described in detail hereunder.

$Z_1$ represents a coupling-removing group, preferably an aryloxy group, an alkoxy group, a heterocyclic oxy group, a silyloxy group, a phosphonoxy group, an alkylthio group, an arylthio group, a heterocyclic thio group, an acylthio group, a thiocyano group, an aminothiocarbonylthio group, an acylamino group, a sulfonamido group, an alkoxycarbonylamino group, an aryloxycarbonylamino group or a nitrogen-containing heterocyclic group which is bonded to the active position of the pyrazolone ring via the nitrogen atom.

Among the compounds of the formula (I), those as represented by the following formula (Ib) are especially preferred.

(Ib)

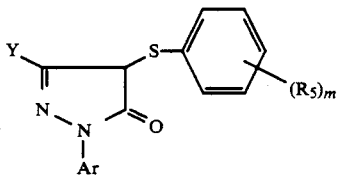

( in which Ar has the same meaning as in the formula (I); $R_5$ represents a hydrogen atom, a halogen atom, an acyl amino group, a sulfonamido group, a carbamoyl group, a sulfamoyl group, an alkylthio group, an alkoxycarbonyl group, a hydroxyl group, an alkyl group, an alkoxy group or an aryl group, which may optionally be substituted; m is an integer of 1 to 5 wherein when m is 2 or more, the $R_5$ groups may be the same or different; and Y represents an acylamino group or an anilino group.

Among the compounds of the formula (Ib), those as represented by the following formula (Ic) are more especially preferred:

(Ic)

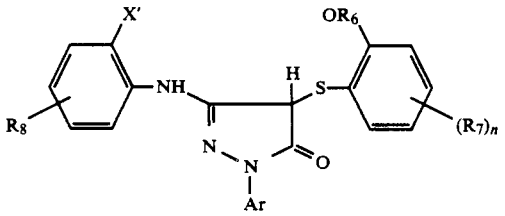

in which Ar has the same meaning as in the formula (I); $R_6$ represents a substituted or unsubstituted alkyl or aryl group; X represents a halogen atom or a substituted or unsubstituted alkoxy group; $R_7$ represents a hydrogen atom, a hydroxyl group, a halogen atom, or a substituted or unsubstituted alkyl, alkoxy or aryl group; $R_8$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxyl group or a trichloromethyl group, which may optionally be substituted by one or more substituents; and n is an integer of 1 to 4.

More precisely, Ar represents a substituted phenyl group, and the substituents on the phenyl nucleus can be selected from a halogen atom (such as a chlorine atom, a bromine atom, a fluorine atom, etc.), an alkyl group having 1 to 22 carbon atoms (such as a methyl group, an ethyl group, a tetradecyl group, a t-butyl group, etc.), an alkoxy group having 1 to 22 carbon atoms (such as a methoxy group, an ethoxy group, an octyloxy group, a dodecyloxy group, etc.), an alkoxycarbonyl group having 2 to 23 carbon atoms (such as a methoxycarbonyl group, an ethoxycarbonyl group, a tetradecyloxycarbonyl group, etc.) and a cyano group.

X' represents a halogen atom (such as a chlorine atom, a bromine atom, a fluorine atom, etc.) or an alkoxy group having 1 to 22 carbon atoms (such as a methoxy group, an octyloxy group, a dodecyloxy group, etc.).

$R_8$ represents a hydrogen atom, a halogen atom (such as a chlorine atom, a bromine atom, a fluorine atom, etc.), a linear or branched alkyl group (such as a methyl group, a t-butyl group, a tetradecyl group, etc.), an alkoxy group (such as a methoxy group, an ethoxy group, a 2-ethylhexyloxy group, a tetradecyloxy group, etc.), an acylamino group (such as an acetamido group, a benzamido group, a butanamido group, a tetradecanamido group, an α-(2,4-di-tert-amylphenoxy)acetamido group, an α-(2,4-di-tert-amylphenoxy)butyramido group, an α-(3-pentadecylphenoxy)hexanamido group, an α-(4-hydroxy-3-tert-butylphenoxy)tetradecanamido group, a 2-oxopyrrolidin-1-yl group, a 2-oxo-5-tetradecylpyrrolidin-1-yl group, an N-methyltetradecanamido group, etc.), a sulfonamido group (such as a methanesulfonamido group, a benzenesulfonamido group, a p-toluenesulfonamido group, an octanesulfonamido group, a p-dodecylbenzenesulfonamido group, an N-methyltetradecanesulfonamido group, etc.), a sulfamoyl group (such as an N-methylsulfamoyl group, an N-hexadecylsulfamoyl group, an N-[3- (dodecyloxy)propyl]-sulfamoyl group, an N-[4-(2,4-di-tert-amylphenoxy)butyl]-sulfamoyl group, an N-methyl-N-tetradecylsulfamoyl group, etc.), a carbamoyl group (such as an N-methylcarbamoyl group, an N-octadecylcarbamoyl group, an N-[4-(2,4-di-tert-amylphenoxy)butyl]carbamoyl group, an N-methyl-N-tetradecylcarbamoyl group, etc.), a diacylamino group (such as an N-succinimido group, an N-phthalimido group, a 2,5-dioxo-1-oxazolidinyl group, a 3-dodecyl-2,5-dioxo1-hydantoinyl group, a 3-(N-acetyl-N-dodecylamino)succinimido group, etc.), an alkoxycarbonyl group (such as a methoxycarbonyl group, a tetradecyloxycarbonyl group, a benzyloxycarbonyl group, etc.), an alkoxysulfonyl group (such as a methoxysulfonyl group, an octyloxysulfonyl group, a tetradecyloxysulfonyl group, etc.), an aryloxysulfonyl group (such as a phenoxysulfonyl group, a 2,4-di-tert-amylphenoxysulfonyl group, etc.), an alkanesulfonyl group (such as a methanesulfonyl group, an octanesulfonyl group, a 2-ethylhexanesulfonyl group, a hexadecanesulfonyl group, etc.), an arylsulfonyl group (such as a benzenesulfonyl group, a 4-nonylbenzenesulfonyl group, etc.), an alkylthio group (such as an ethylthio group, a hexylthio group, a benzylthio group, a tetradecylthio group, a 2-(2,4-di-tert-amylphenoxy)ethylthio group, etc.), an arylthio group (such as a phenylthio group, a p-tolylthio group, etc.), an alkyloxycarbonylamino group (such as an ethyloxycarbonylamino group, a benzyloxycarbonylamino group, a hexadecyloxycarbonylamino group, etc.), an alkylureido group (such as an N-methylureido group, an N,N-dimethylureido group, an N-methyl-N-dodecylureido group, an N-hexadecylureido group, an N,N-dioctadecylureido group, etc.), an acyl group (such as an acetyl group, a benzoyl group, an octadecanoyl group, a p-dodecanamidobenzoyl group, etc.), a nitro group, a carboxyl group or a trichloromethyl group. In these substituents, the alkyl group preferably contains 1 to 36 carbon atoms, and the aryl group preferably contains 6 to 38 carbon atoms.

$R_6$ represents more precisely a substituted or unsubstituted alkyl group having 1 to 22 carbon atoms (such as a methyl group, a propyl group, a butyl group, a 2-methoxyethyl group, a methoxymethyl group, a hexyl group, a 2-ethylhexyl group, a dodecyl group, a hexadecyl group, a 2-(2,4-di-tert-amylphenoxy)ethyl group, a 2-dodecyloxyethyl group, etc.) or a substituted or unsubstituted aryl group (such as a phenyl group, an $\alpha$- or $\beta$-naphthyl group, a 4-tolyl group, etc.).

$R_7$ represents a hydrogen atom or a hydroxyl group or represents a halogen atom, an alkyl group, an alkoxy group or an aryl group, which is exemplified in the above-mentioned $R_8$.

Among the couplers as represented by the formula (Ic), those in which the sum of the carbon atoms of $R_6$ and $R_7$ is 6 or more are especially preferred for effectively attaining the object of the present invention.

The pyrazoloazole type couplers as represented by the formula (II) are described in detail hereunder.

In the formula (II), the polymers mean compounds having two or more groups of the formula (II) in one molecule, which include bis forms and polymer couplers. The polymer couplers may be homopolymers exclusively comprising the monomers which contain the part as represented by the formula (II) (which preferably contain a vinyl group and are referred to as vinyl monomers hereunder) or may otherwise be copolymerized polymers comprising the monomers and other non-coloring ethylenic monomers which are not coupled with an oxidized form of an aromatic primary amine developing agent.

Among the pyrazoloazole type couplers of the formula (II), those of the following formulae (IIa), (IIb), (IIc), (IId) and (IIe) are preferred:

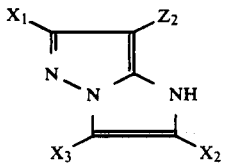
(IIa)

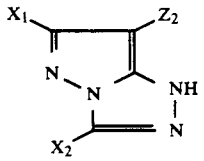
(IIb)

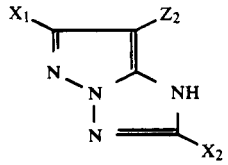
(IIc)

-continued

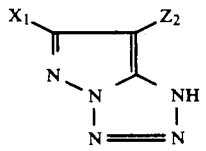
(IId)

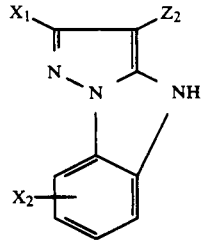
(IIe)

In particular, the compounds of the formulae (IIa), (IIb) and (IIc) are especially preferred among the compounds of the above-mentioned formulae (IIa) through (IIe) in view of the object of the present invention, and the compounds of the formula (IIc) are most preferred.

In the formulae (IIa) through (IIe), $X_1$, $X_2$ and $X_3$ may be the same or different from one another, and each represents a hydrogen atom, a halogen atom, an alkyl group, an aryl group, a heterocyclic group, a cyano group, an alkoxy group, an arylcxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group, which may optionally be substituted by one or more substituents. (The groups as exemplified in the following explanation may optionally be substituted.) $Z_2$ represents a hydrogen atom, a halogen atom or a carboxyl group or represents a group which is bonded to the carbon atom of the coupling position via an oxygen atom, a nitrogen atom or a sulfur atom and which may be removed by coupling. $X_1$, $X_2$, $X_3$ or $Z_2$ may be a divalent group to form a bis form compound.

The present invention includes the use of the polymer couplers containing the coupler residue as represented by the above-mentioned formulae (IIa) through (IIe) in the main chain or the side chain thereof, and, in particular, the polymer couplers as derived from vinyl monomers containing the part cf these general formulae are preferred, where $X_1$, $X_2$, $X_3$ or $Z_2$ represents a vinyl group or a linking group.

The substituents in the above-mentioned general formulae (IIa) through (IIe) are described in detail hereunder.

$X_1$, $X_2$ and $X_3$ each represents more precisely a hydrogen atom, a halogen atom (such as a chlorine atom, a bromine atom, etc.), an alkyl group (such as a methyl group, a propyl group, an isopropyl group, a t-butyl group, a trifluoromethyl group, a tridecyl group, a 3-(2,4-di-t-amylphenoxy)propyl group, a 2-(2-octyloxy-5-tert-octylbenzenesulfonamido)ethyl group, an allyl group, a 2-dodecyloxyethyl group, a 3-phenoxypropyl group, a 2-hexylsulfonylethyl group, a cyclopentyl group, a benzyl group, etc.), an aryl group (such as a phenyl group, a 4-t-butylphenyl group, a 2,4-di-t-amylphenyl group, a 4-tetradecanamidophenyl group, etc.), a heterocyclic group (such as a 2-furyl group, a 2-thienyl group, a 2-pyrimidinyl group, a 2-benzothiazolyl group, etc.), a cyano group, an alkoxy group (such as a methoxy group, an ethoxy group, a 2-methoxyethoxy group, an isopropoxy group, a 2-dodecyloxyethoxy group, a 2-methanesulfonylethoxy group, etc.), an aryloxy group (such as a phenoxy group, a 2-methylphenoxy group, a 4-t-butylphenoxy group, etc.), a heterocyclic oxy group (such as a 2-benzimidazolyloxy group, etc.), an acyloxy group (such as an acetoxy group, a hexadecanoyloxy group, etc.), a carbamoyloxy group (such as an N-phenylcarbamoyloxy group, an N-ethylcarbamoyloxy group, etc.), a silyloxy group (such as a trimethylsilyloxy group, etc.), a sulfonyloxy group (such as a dodecylsulfonyloxy group, etc.), an acylamino group (such as an acetamido group, a benzamido group, a tetradecanamido group, an α-(2,4-di-t-amylphenoxy)butyramido group, an α-(3-t-butyl-4-hydroxyphenoxy)butyramido group, an α-[4-(4-hydroxyphenylsulfonyl)phenoxy]decanamido group, etc.), an anilino group (such as a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-t-butyl-4-hydroxyphenoxy)-dodecanamido]anilino group, etc.), a ureido group (such as a phenylureido group, a methylureido group, an N,N-dibutylureido group, etc.), an imido group (such as an N-succinimido group, a 3-benzylhydantoinyl group, a 4-(2-ethylhexanoylamino)phthalimido group, etc.), a sulfamoylamino group (such as an N,N-dipropylsulfamoylamino group, an N-methyl-N-decylsulfamoylamino group, etc.), an alkylthio group (such as a methylthio group, an octylthio group, a tetradecylthio group, a 2-phenoxyethylthio group, a 3-phenoxypropylthio group, a 3-(4-t-butylphenoxy)propylthio group, etc.), an arylthio group (such as a phenylthio group, a 2-butoxy5-t-octylphenylthio group, a 3-pentadecylphenylthio group, a 2-carboxyphenylthio group, a 4-tetradecanamidophenylthio group, etc.), a heterocyclic thio group (such as a 2-benzothiazolylthio group, etc.), an alkoxycarbonylamino group (such as a methoxycarbonylamino group, a tetradecyloxycarbonylamino group, etc.), an aryloxycarbonylamino group (such as a phenoxycarbonylamino group, a 2,4-di-tert-butylphenoxycarbonylamino group, etc.), a sulfonamido group (such as a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a carbamoyl group (such as an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]carbamoyl group, etc.), an acyl group (such as an acetyl group, a (2,4-di-tert-amylphenoxy)acetyl group, a benzoyl group, etc.), a sulfamoyl group (such as an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (such as a methanesulfonyl group, an octanesulfonyl group, a benzenesulfonyl group, a toluenesulfonyl group, etc.), a sulfinyl group (such as an octanesulfinyl group, a dodecylsulfinyl group, a phenylsulfinyl group, etc.), an alkoxycarbonyl group (such as a methoxycarbonyl group, a butyloxycarbonyl group, a dodecyloxycarbonyl group, an octadecylcarbonyl group, etc.) or an aryloxycarbonyl group (such as a phenyloxycarbonyl group, a 3-pentadecyloxycarbonyl group, etc.); $Z_2$ represents more precisely a hydrogen atom, a halogen atom (such as a chlorine atom, a bromine atom, an iodine atom, etc.), a carboxyl group, or a group as linked via an oxygen atom (such as an acetoxy group, a propanoyloxy group, a benzoyloxy group, a 2,4-dichlorobenzoyloxy group, an ethoxyoxaloyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxyhydantoinyl group, a 5-methyl-1-tetrazolyl group, etc.), an arylazo group (such as 4-methoxyphenylazo group, a 4-pivaloylaminophenylazo group, a 2-naphthylazo group, a 3-methyl-4-hydroxyphenylazo group, etc.), or a group as linked via a sulfur atom (such as a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

Of the couplers of the formulae (IIa) to (IIe), the couplers of the formulae (IIa), (IIb) and (IIc) are preferable and the coupler of the formula (IIc) is the most preferable. In these formulae, at least one of $X_1$ and $X_2$ are preferably a branched substituted or unsubstituted alkyl group, that is an alkyl group or a substituted alkyl group which is connected to a pyrazoloazole skeleton through a secondary or tertiary carbon atom, wherein a secondary carbon atom means a carbon atom to which only one hydrogen atom is directly connected, and a tertiary carbon atom means a carbon atom to which no hydrogen atom but preferably an alkyl group or a substituted alkyl group is directly connected. The examples of the substituted alkyl group are a sulfonamidoalkyl group, a sulfonamidoarylalkyl group, a sulfonylalkyl group and the like, wherein a sulfonamidoarylsulfonamidoalkyl group is preferable as a sulfonamidoalkyl group.

In the couplers of the formula (IIa), $X_2$ and $X_3$ may be bonded to form a 5-membered to 7-membered ring.

In the case where $X_1$, $X_2$, $X_3$ or $Z_2$ is a divalent group to form a bis form compound, $X_1$, $X_2$ and $X_3$ each preferably represents a substituted or unsubstituted alkylene group (such as a methylene group, an ethylene group, a 1,10-decylene group, $—CH_2CH_2—O—CH_2CH_2—$, etc.), a substituted or unsubstituted phenylene group (such as a 1,4-phenylene group, a 1,3-phenylene group,

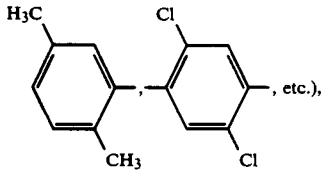

or a group of the formula —NHCO—$X_4$—CONH— (in which $X_4$ represents a substituted or unsubstituted alkylene group or phenylene group, for example, —NHCO$CH_2CH_2$CONH—,

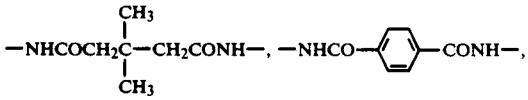

etc.), or a group of the formula —S—$X_4$—S— (in which $X_4$ represents a substituted or unsubstituted alkylene group, for example, —S—$CH_2CH_2$—S—,

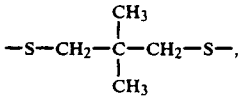

etc.); and the divalent group of $Z_2$ is derived from the above-mentioned monovalent group of $Z_2$ by converting the monovalency of the latter into the corresponding 2-valency of the former.

In the case where the parts of the formulae (IIa), (IIb), (IIc), (IId) and (IIe) are contained within vinyl monomers, the linking group as represented by $X_1$, $X_2$, $X_3$ or $Z_2$ includes a group comprising the combination of groups as selected from an alkylene group (or a substituted or unsubstituted alkylene group, such as a methylene group, an ethylene group, a 1,10-decylene group, —$CH_2CH_2OCH_2CH_2$—, etc.), a phenylene group (or a substituted or unsubstituted phenylene group such as a 1,4-phenylene group, a 1,3-phenylene group,

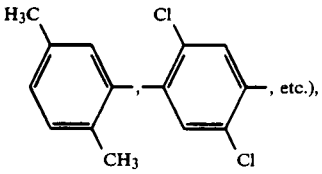

—NHCO—, —CONH—, —O—, —OCO— and an aralkylene group (such as

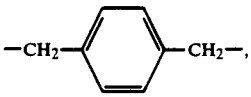

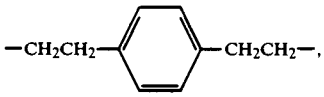

-continued

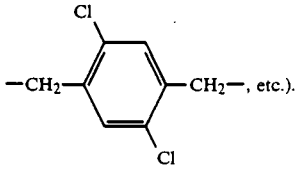

Preferred linking groups are as follows: —NHCO—, —$CH_2CH_2$—,

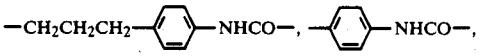

—$CH_2CH_2$NHCO—,

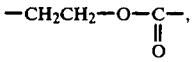

—CONH—$CH_2CH_2$NHCO—, —$CH_2CH_2$O—$CH_2CH_2$—NHCO—,

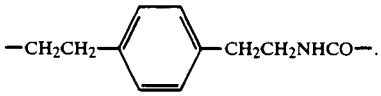

The vinyl group in the monomers may have substituent(s) other than the group of the abovementioned formula (IIa), (IIb), (IIc), (IId) or (IIe), preferably selected from a chlorine atom and a lower alkyl group having 1 to 4 carbon atoms (such as a methyl group or an ethyl group).

The monomers containing the group of the formula (IIa), (IIb), (IIc), (IId) or (IIe) may be copolymerized with non-coloring ethylenic monomers which are not coupled with an oxidation product of an aromatic primary amine developing agent to form copolymers.

The non-coloring ethylenic monomers which are not coupled with an oxidation product of an aromatic primary amine developing agent include, for example, acrylic acid, α-chloroacrylic acid, α-alkylacrylic acids (such as methacrylic acid) and esters or amides derived from these acrylic acids (such as acrylamide, n-butylacrylamide, t-butylacrylamide, diacetonacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate and β-hydroxyethyl methacrylate), and methylenedibisacrylamide, vinyl esters (such as vinyl acetate, vinyl propionate and vinyl laurate), acrylonitrile, methacrylonitrile, aromatic vinyl compounds (such as styrene and derivatives thereof, e.g., vinyltoluene, divinylbenzene, vinylacetophenone and sulfostyrene), itaconic acid, citraconic acid, crotonic acid, vinylidene chloride, vinylalkyl ethers (such as vinylethyl ether), maleic acid, maleic anhydride, maleates, N-vinyl-2-pyrrolidone, N-vinylpyridine and 2- and 4-vinylpyridines. In the practice of the present invention, two or more kinds of the above-described non-coloring ethylenic unsaturated monomers may be used together. For instance, the combination of n-butyl acrylate/methyl acrylate, styrene/methacrylic acid, methacrylic acid/acrylamide, and methyl acrylate/diacetonacrylamide are exemplified.

As is well known in the field of polymer color couplers, the non-coloring ethylenic unsaturated monomers to be copolymerized with water-insoluble monomer coupler solids can be so selected that these non-coloring monomers may have a good influence on the physical property and/or the chemical property of the copolymer to be formed by the copolymerization, for example, the solubility thereof, the compatibility thereof with a binder for photographic colloid compositions (such as gelatin), the flexibility thereof as well as the thermal stability thereof.

The polymer coupler to be used in the practice of the present invention may be either soluble or insoluble in water and, in particular, polymer coupler latexes are especially preferred among them.

Next, the compounds as represented by the general formula (III) will be explained in detail hereunder. A represents a substituted or unsubstituted alkyl group (such as a methyl group, an ethyl group, a benzyl group, an allyl group, a cyclohexyl group, an octyl group, a hydroxyethyl group, a hexanoyloxymethyl group, a 2-ethylhexyl group, a dodecyl group, a hexadecyl group, an octadecenyl group, etc.), an aryl group (such as a phenyl group, a 4-tert-butylphenyl group, a 3-pentadecylphenyl group, a 3-(2-ethylhexanamido)phenyl group, a 3-naphthyl group, etc.), a heterocyclic group (such as a furfuryl group, a pyridyl group, etc.), an acyl group (such as an acetyl group, a heptanoyl group, a 2-ethylhexanoyl group, a benzoyl group, a dodecanoyl group, etc.), an alkoxy group (such as a methoxy group, a hexyl group, a 2-ethylhexyl group, a dodecyloxy group, a hexadecyloxy group, a 2-dodecyloxyethoxy group, a 2-(2-octyloxy-5-tert-octylbenzenesulfonamido)ethoxy group, etc.), an aryloxy group (such as a phenyloxy group, a 2,4-di-tert-amylphenoxy group, a 3-pentadecylphenoxy group, a cholestan-3-oxy group, etc.), a heterocyclic oxy group (such as a 3-pyridyloxy group, a 2-furfuryloxy group, etc.), an alkylthio group (such as an ethylthio group, a hexylthio group, a dodecylthio group, a benzylthio group, a cyclohexylthio group, an octylthio group, etc.), an arylthio group (such as a phenylthio group, a 4-octyloxyphenylthio group, a 4-tert-butylphenylthio group, a 3-pentadecylphenylthio group, etc.) or an amino group (such as an amino group, an N-methylamino group, an N,N-diethylamino group, an N,N-dihexylamino group, an anilino group, a 2-chloroanilino group, a 4-anisidyl group, a 4-cyanoanilino group, a 2-(dodecyloxy)ethylamino group, a 4-(2,4-di-tert-amylphenoxy)butylamino group, a 2-pyridylamino group, a 2,6-pyrimidylamino group, an N-dodecylamino group, etc.). The compounds of the formula (III) may form dimers via the group A. In the formula (III), the substituted or unsubstituted alkyl group and aryl group in the groups of $R_1$, $R_2$, $R_{3a}$, $R_{3b}$ and $R_4$; an alkoxy group, an aryloxy group, an alkylthio group and an arylthio group in the groups of $R_{3a}$ and $R_{3b}$; and a heterocyclic group in the group of $R_4$ are the same as those of the above-mentioned group A. D represents an oxygen atom or a sulfur atom, and is especially preferably an oxygen atom. A is preferably a substituted or unsubstituted alkoxy group. The substituent A preferably does not contain an acid group such as a carboxylic acid or sulfonic acid group.

Typical examples of the compounds of the general formula (I), (II) or (III), which are preferably used in the present invention, are given below, but these are not whatsoever limitative.

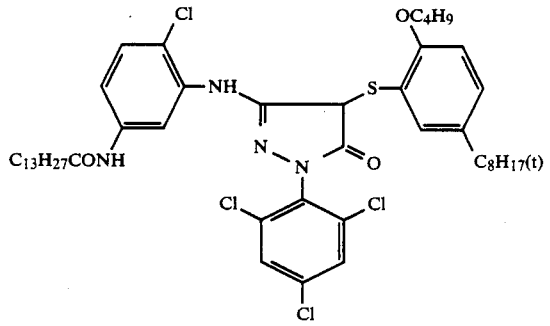

(I-1)

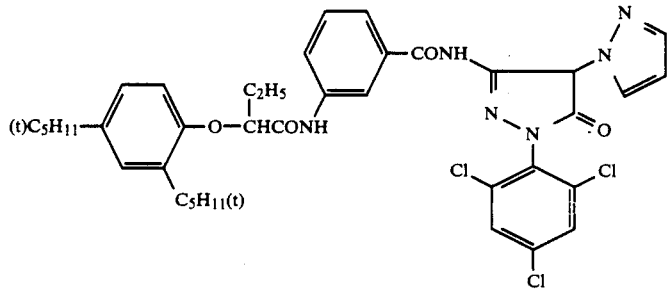

(I-2)

-continued
(I-3)
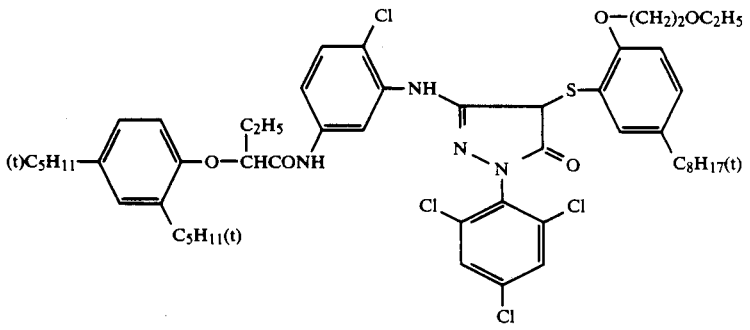
(I-4)
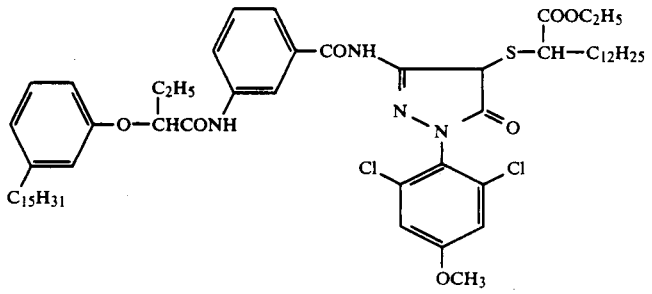
(I-5)
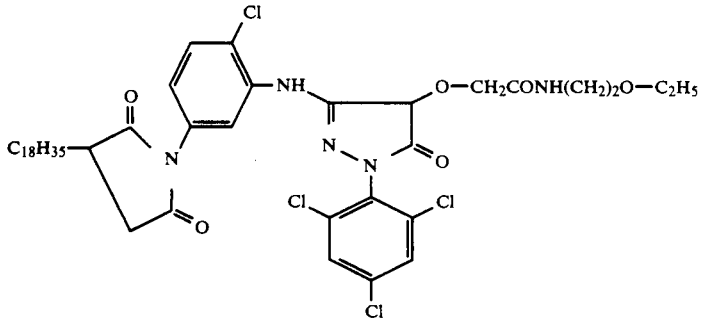
(I-6)
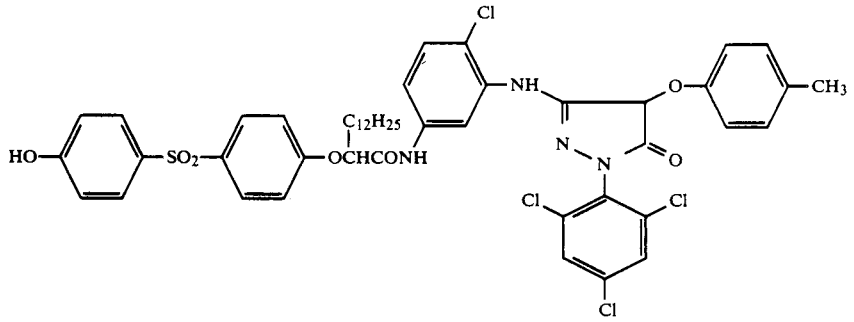
(I-7)
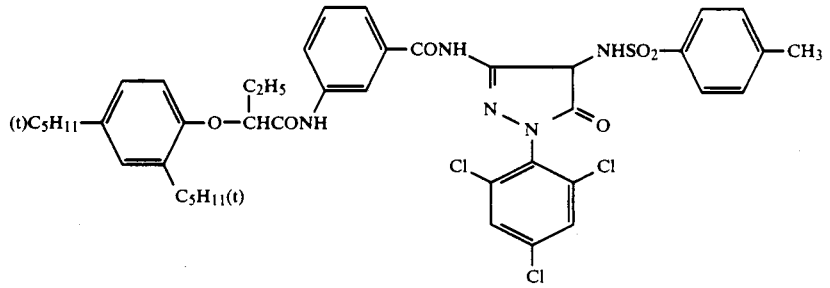

-continued
(I-8)
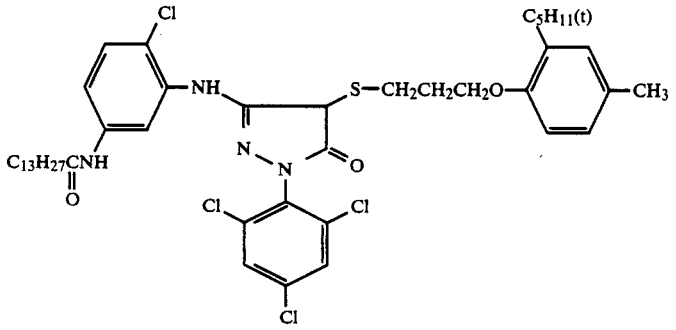
(I-9)
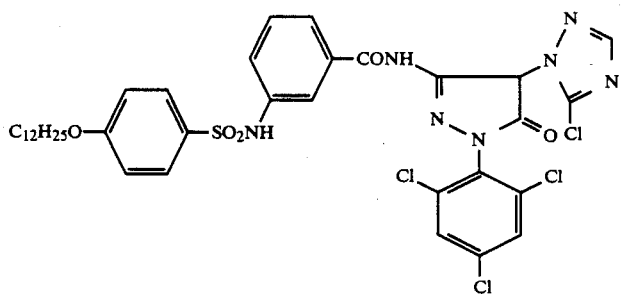
(I-10)
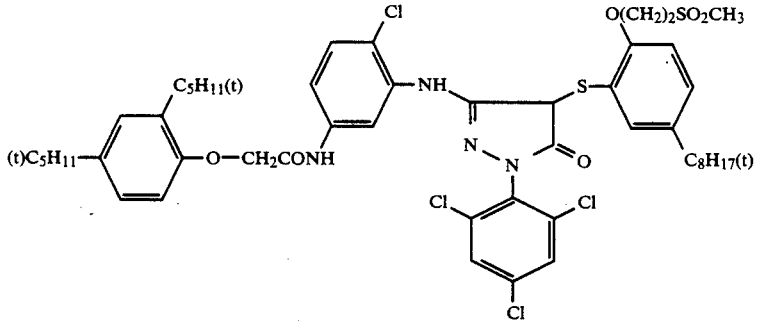
(I-11)
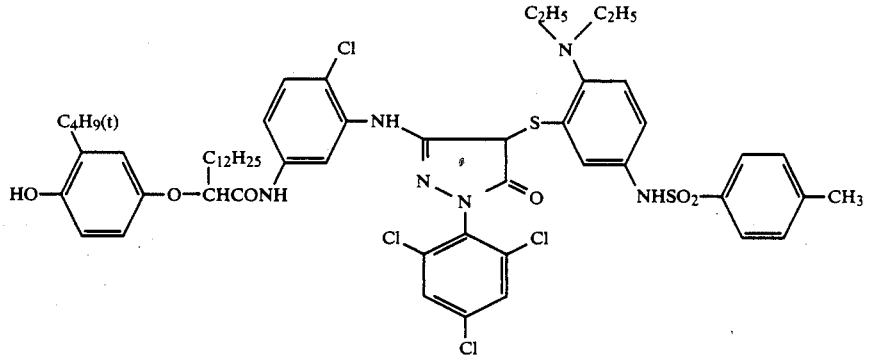
(I-12)
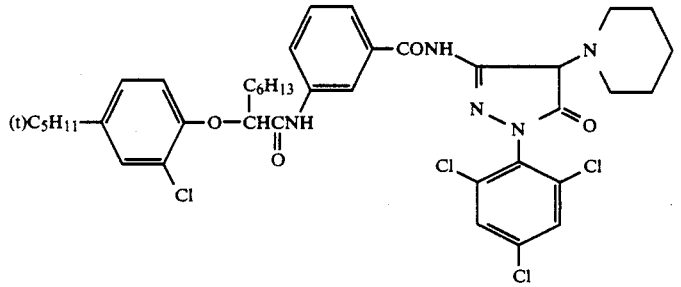

-continued
(I-13)
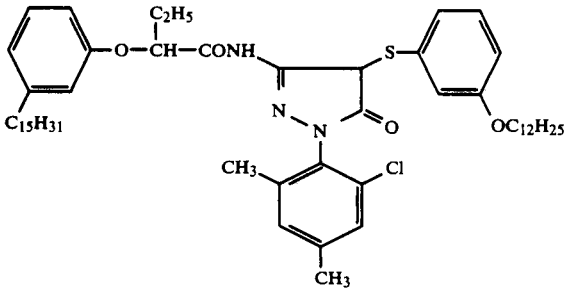
(I-14)
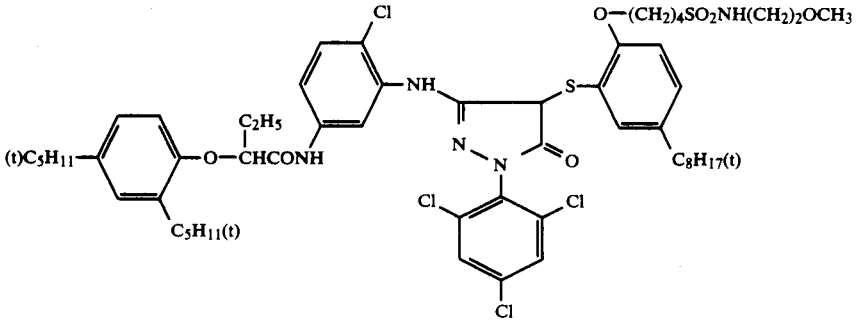
(II-1)
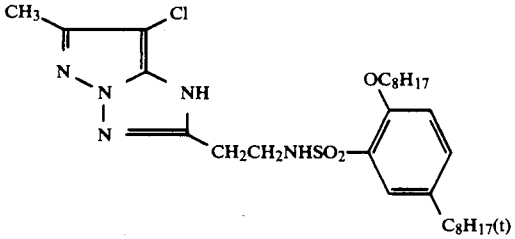
(II-2)
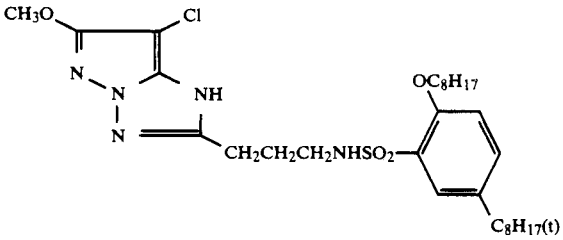
(II-3)
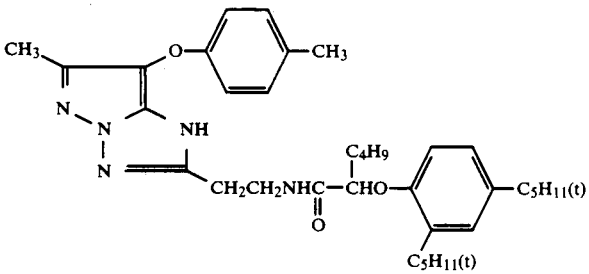

-continued
(II-4)
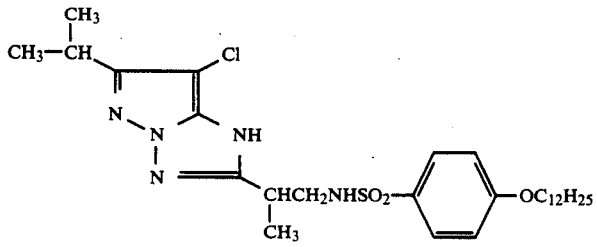
(II-5)
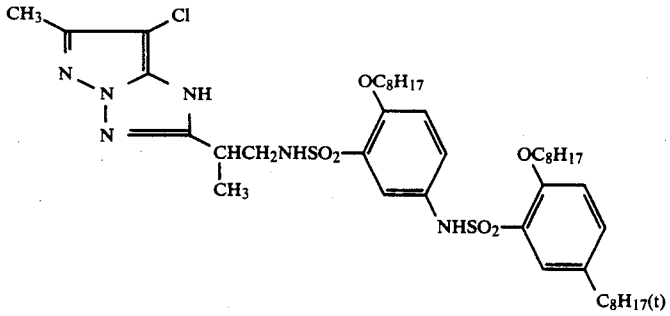
(II-6)
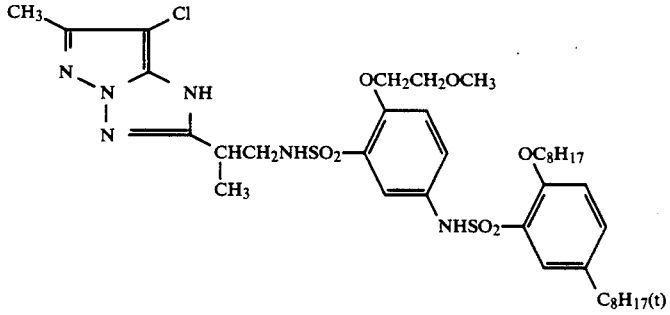
(II-7)
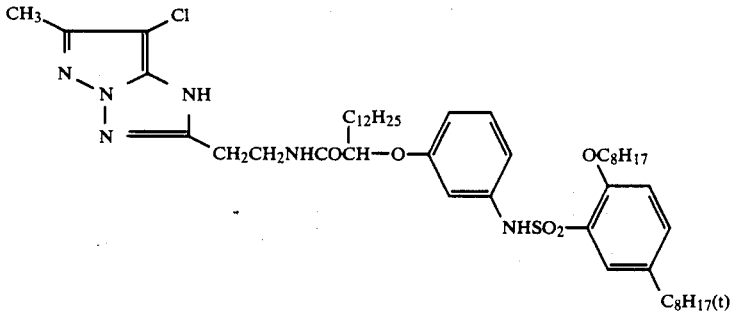
(II-8)
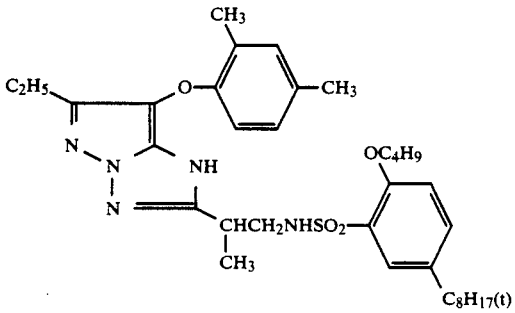

-continued
(II-9)
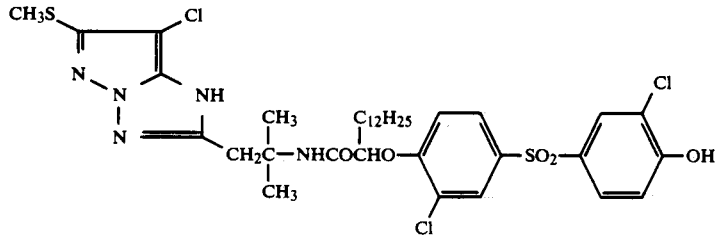
(II-10)
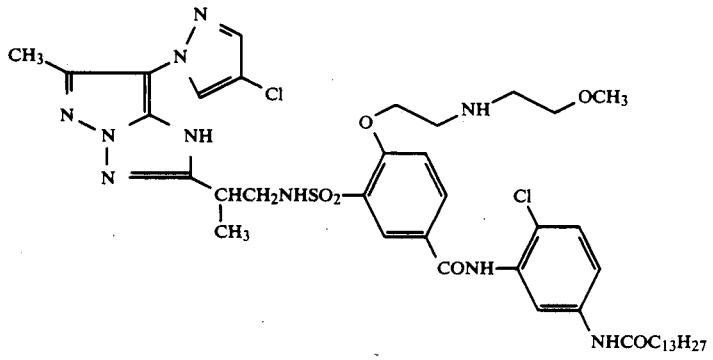
(II-11)
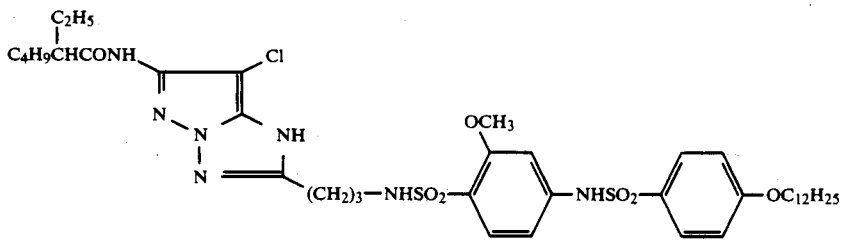
(II-12)
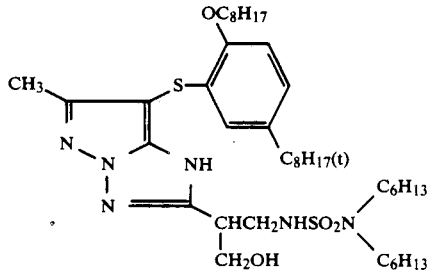
(II-13)
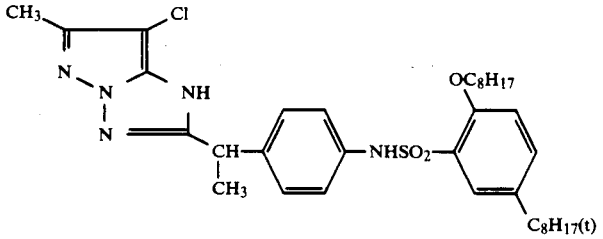
(II-14)
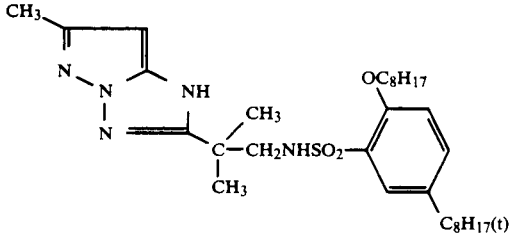

-continued
(II-15)
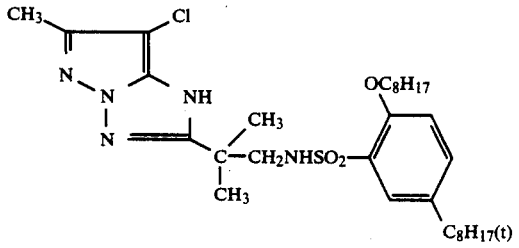
(II-16)
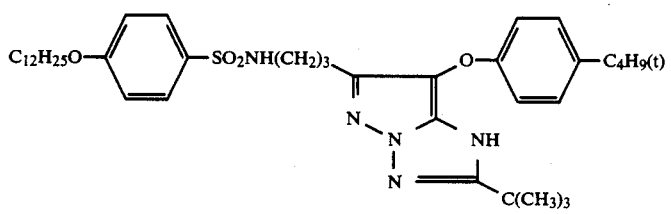
(II-17)
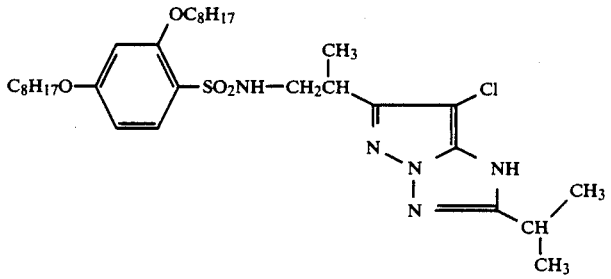
(II-18)
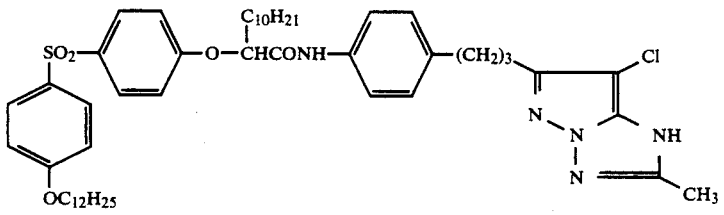
(II-19)
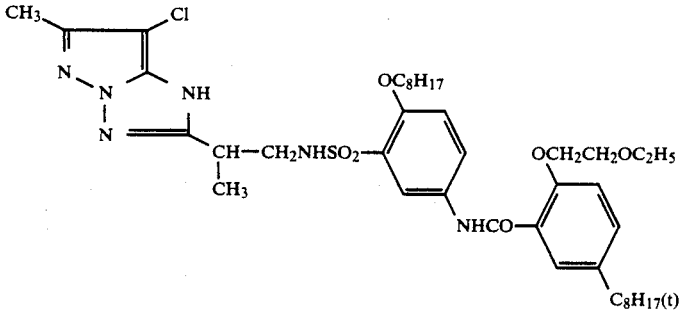
(II-20)
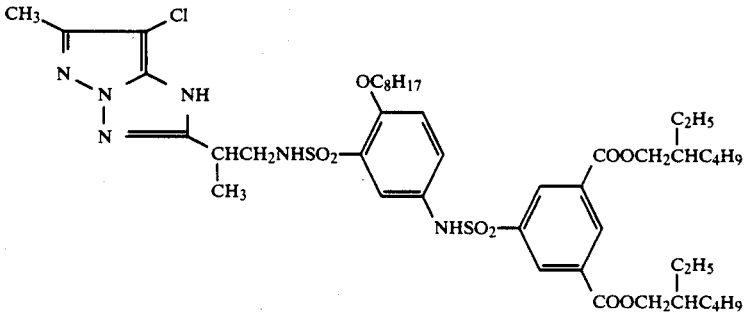

-continued
(II-21)
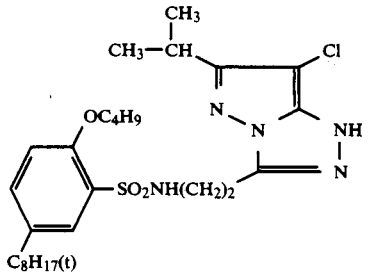
(II-22)
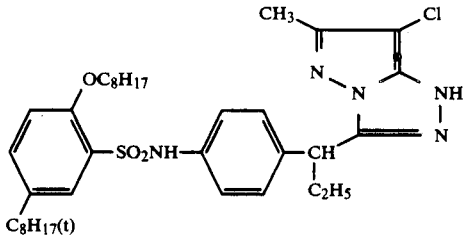
(II-23)
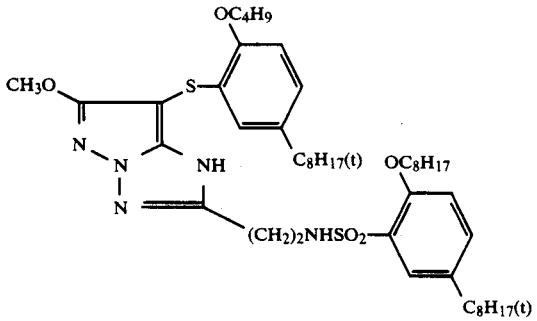
(II-24)
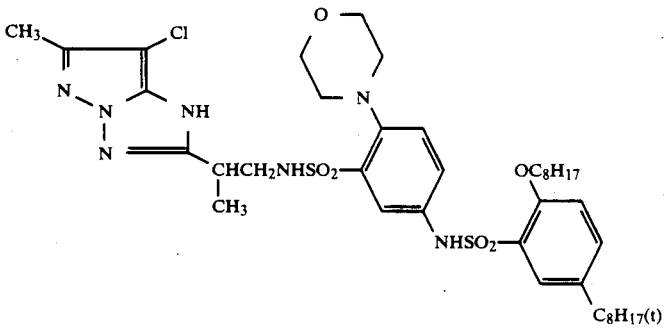
(II-25)
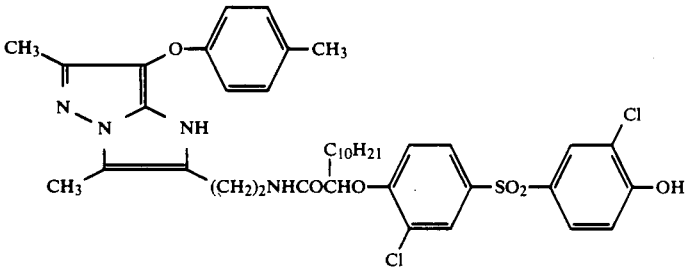

-continued
(II-26)
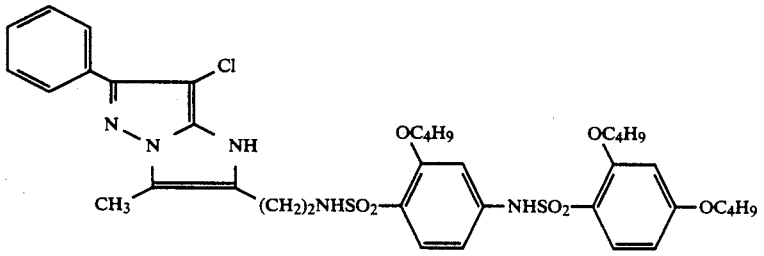
(II-27)
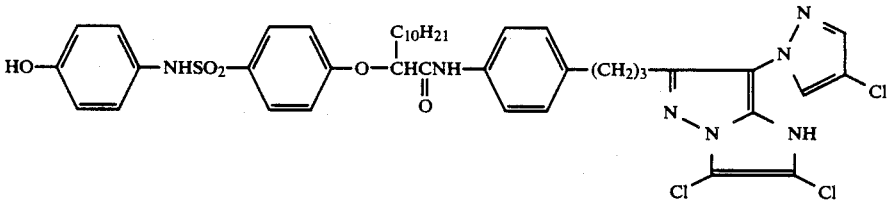
(II-28)
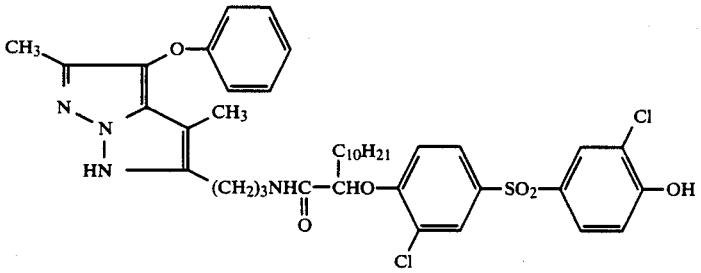
(II-29)
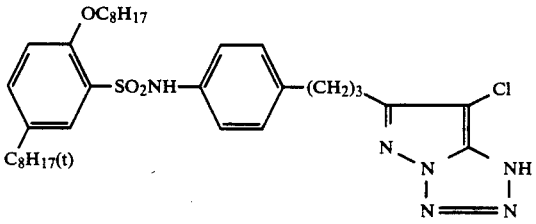
(II-30)
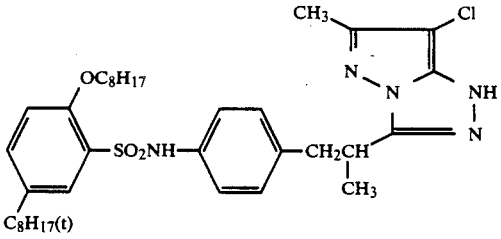
(II-31)
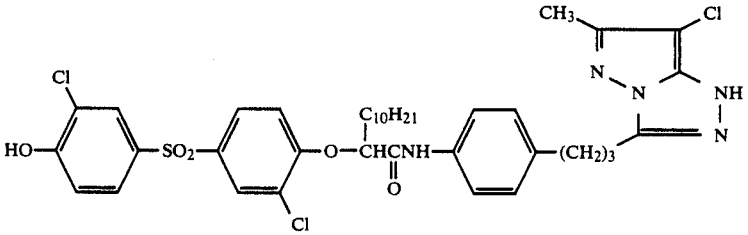

-continued
(II-32)
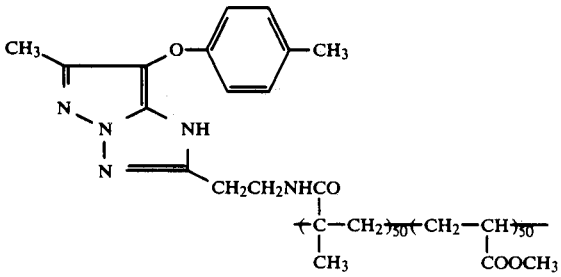
(II-33)
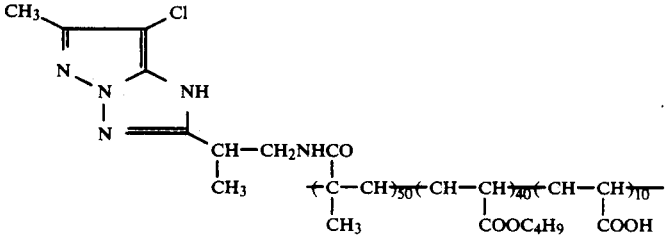
(II-34)
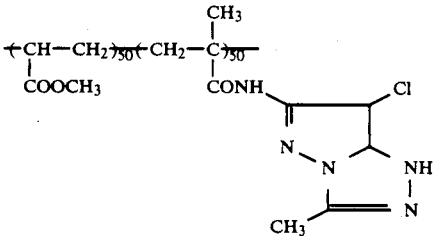
(II-35)
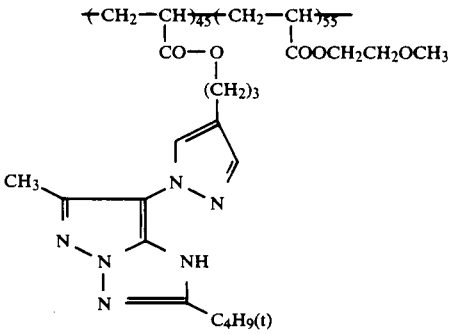
(II-36)
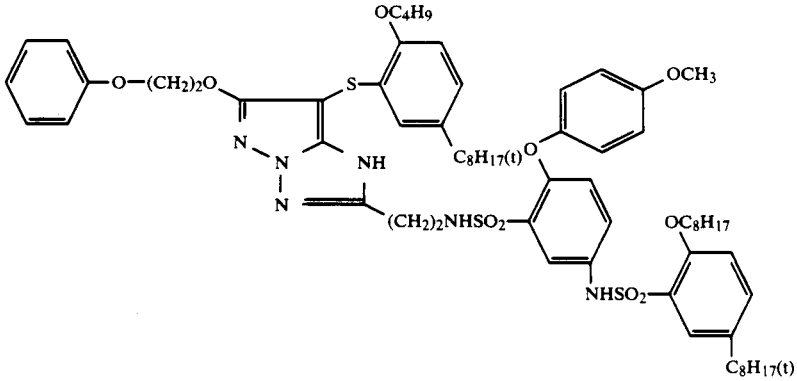

-continued
(II-37)
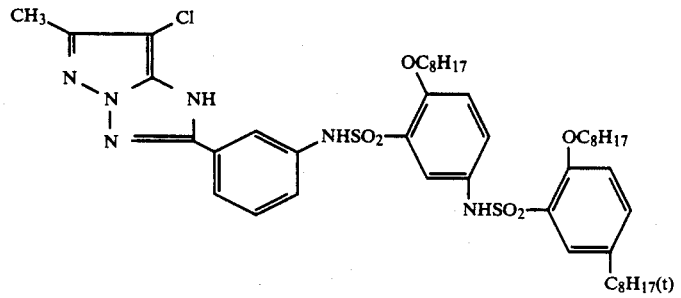
(II-38)
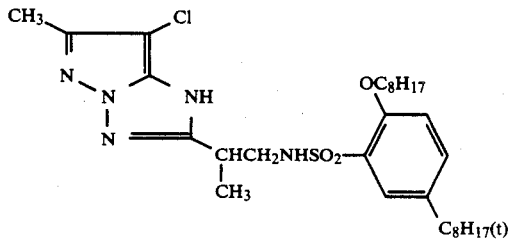
(II-39)
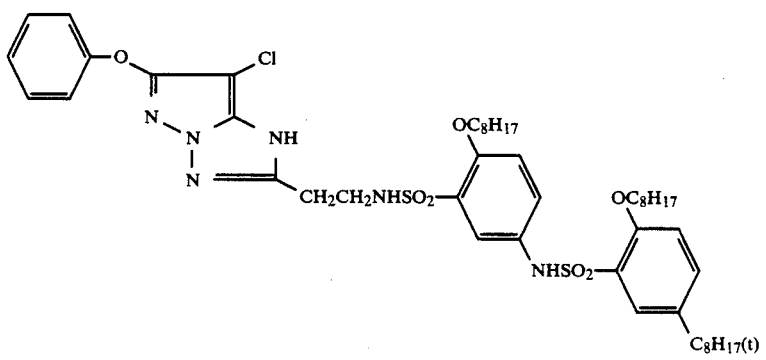
(II-40)
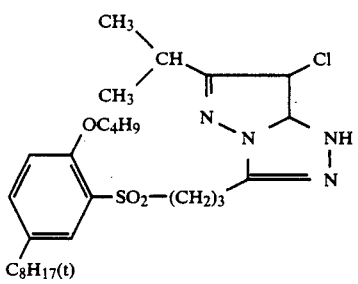
(II-41)
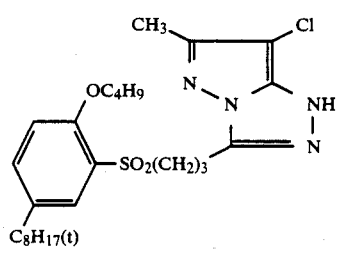

-continued
(II-42)
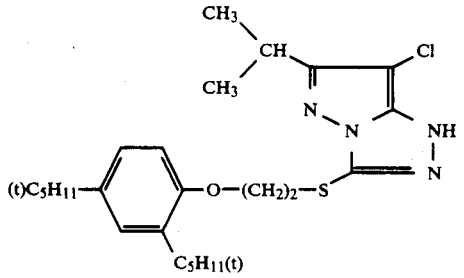
(II-43)
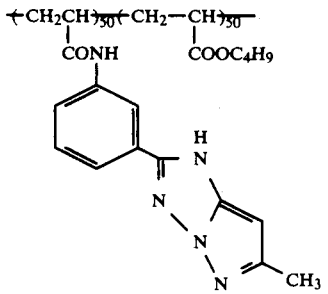
(III-1)
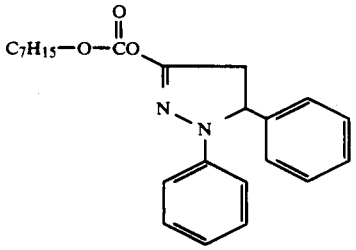
(III-2)
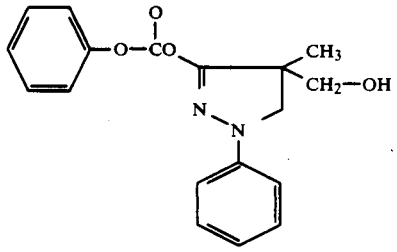
(III-3)
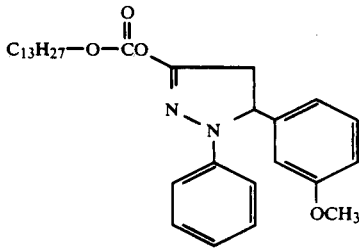
(III-4)
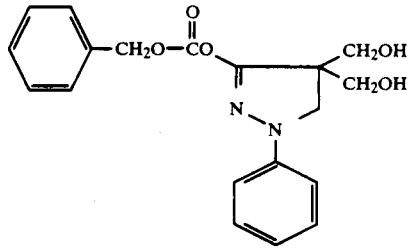

-continued
(III-5)
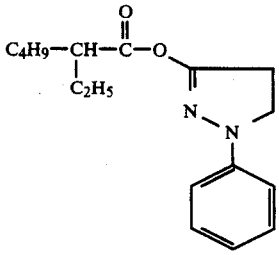
(III-6)
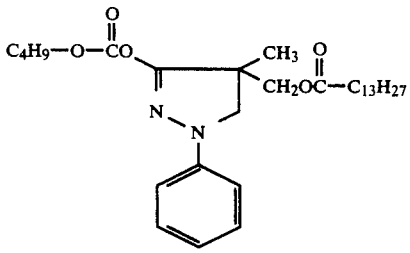
(III-7)
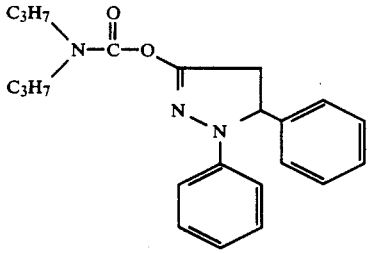
(III-8)
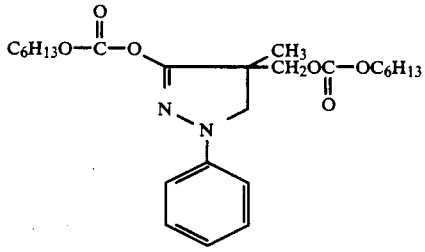
(III-9)
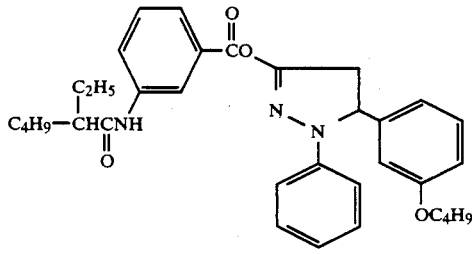
(III-10)
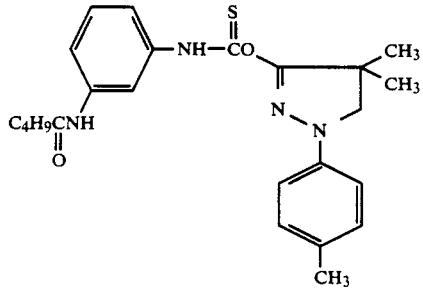

-continued
(III-11)
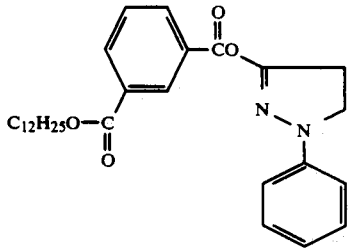
(III-12)
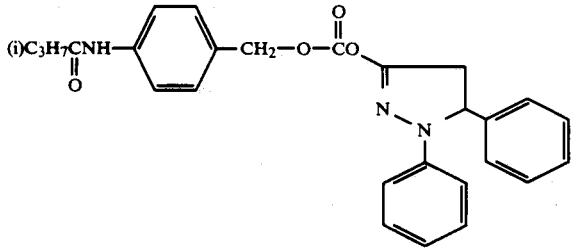
(III-13)
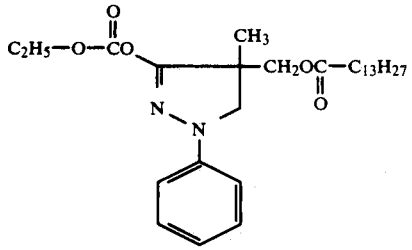
(III-14)
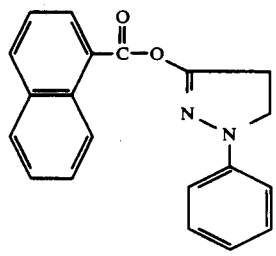
(III-15)
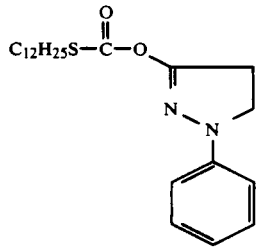
(III-16)
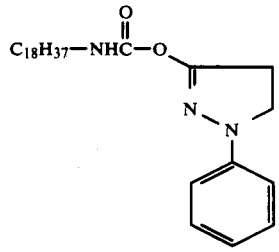

-continued
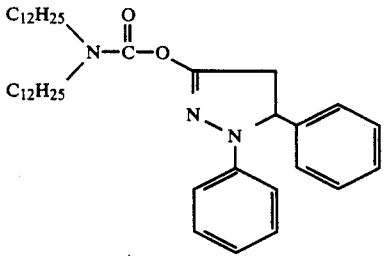
(III-17)
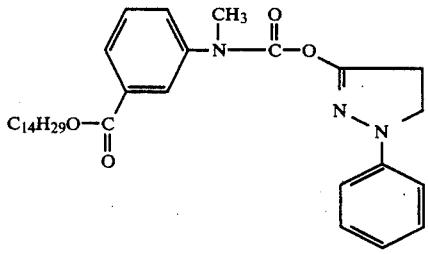
(III-18)
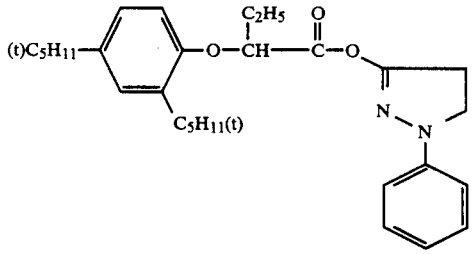
(III-19)
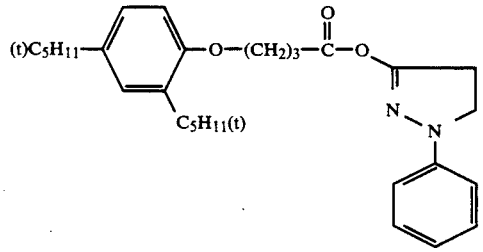
(III-20)
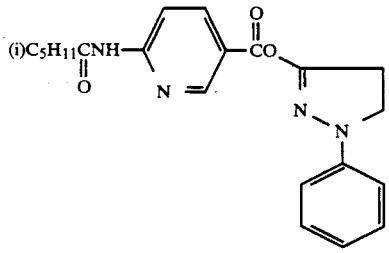
(III-21)
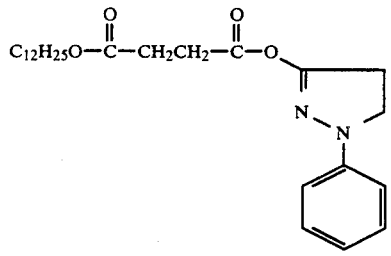
(III-22)

-continued
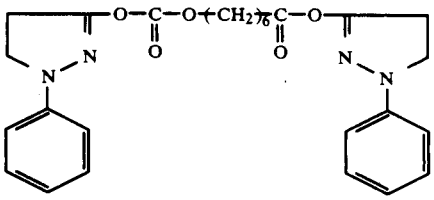
(III-23)
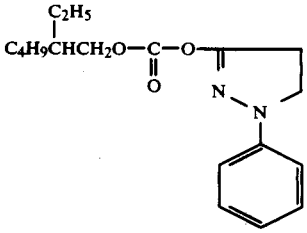
(III-24)
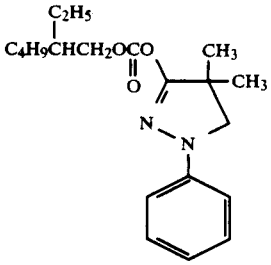
(III-25)
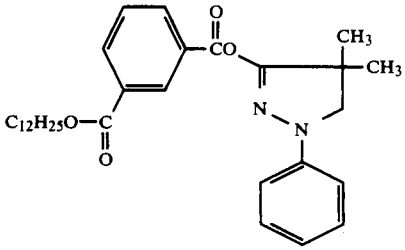
(III-26)
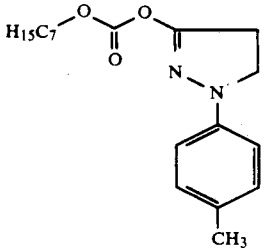
(III-27)
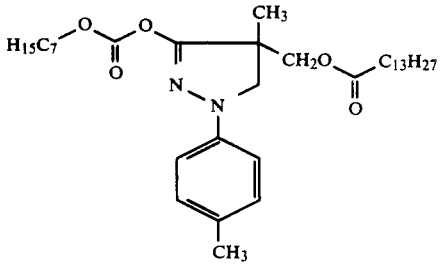
(III-28)

-continued
(III-29)
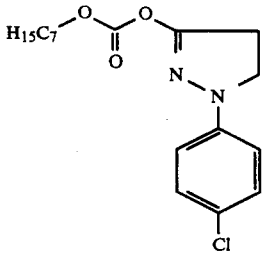
(III-30)
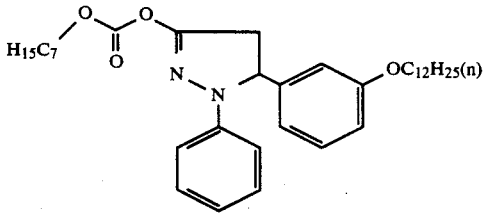
(III-31)
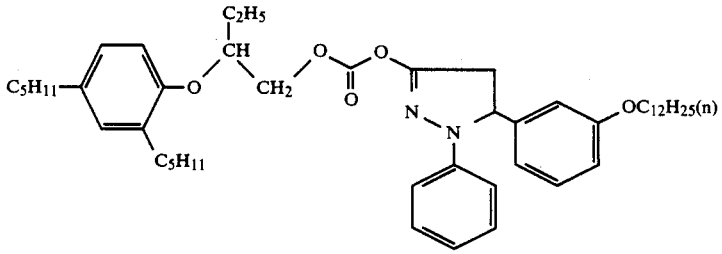
(III-32)
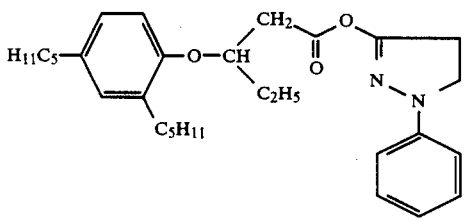
(III-33)
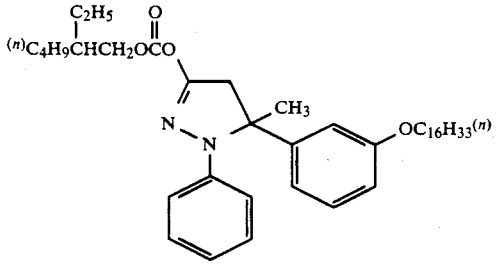
(III-34)
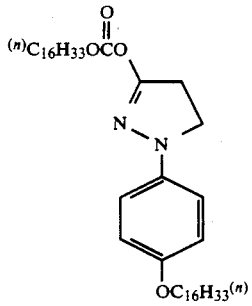

-continued
(III-35)
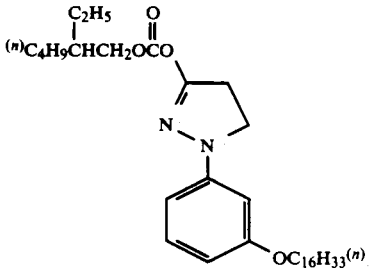
(III-36)
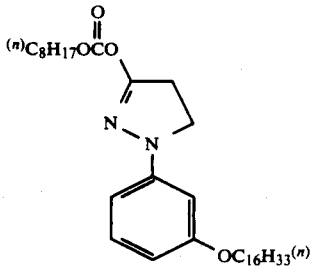
(III-37)
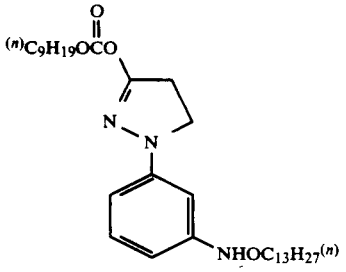
(III-38)
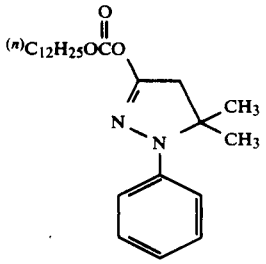
(III-39)
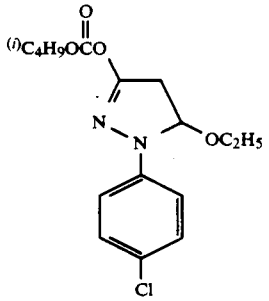
(III-40)
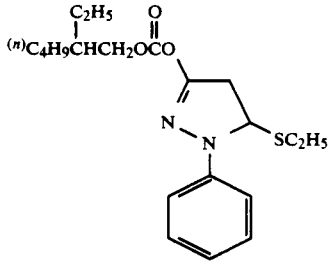

-continued
(III-41)
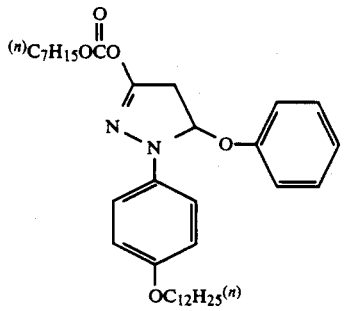
(III-42)
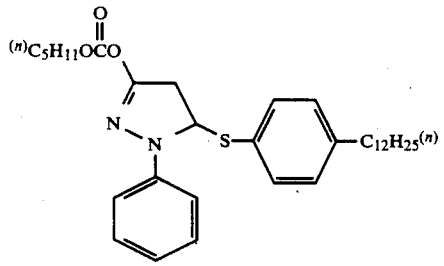
(III-43)
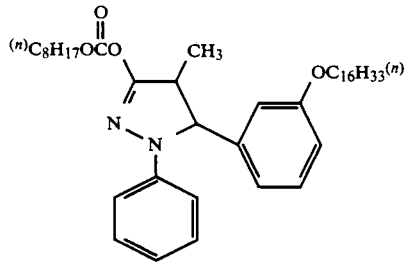
(III-44)
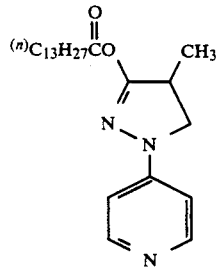
(III-45)
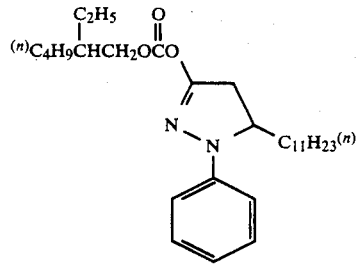
(III-46)
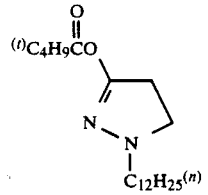

-continued
(III-47)
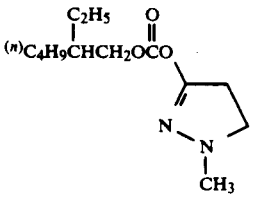
(III-48)
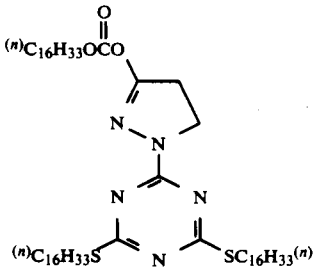
(III-49)
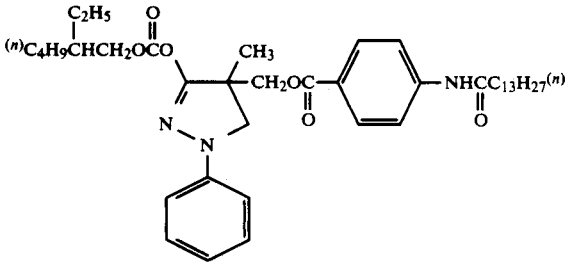
(III-50)
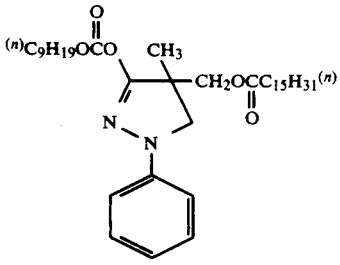
(III-51)
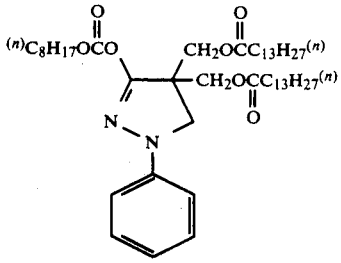
(III-52)
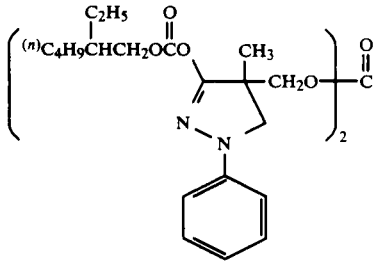
The couplers of the formulae (I) and (II) can be synthesized in accordance with the methods as referred to in the above-mentioned patent specifications. The compounds of the formula (III) can be synthesized by the methods as described in the above-mentioned Japanese Patent Application (OPI) Nos. 40245/82 and 104641/84 or in the similar manner thereto.

The coupler of the formula (I) or (II) is added to the emulsion layer of photographic light-sensitive materials, preferably in an amount of $1\times10^{-3}$ mol to 1 mol, more preferably $5\times10^{-2}$ mol to $5\times10^{-1}$ mol, per 1 mol of the silver halide present in the layer.

The amount of the compound (III) to be added to the emulsion layer is preferably 1 mol % to 200 mol %, especially preferably 2 mol % to 30 mol %, on the basis of the coupler of the formula (I) or (II).

The combination of the compound of the formula (III) and the coupler of the formula (II) is especially preferred.

In the practice of the present invention, the oleophilic coupler(s) of the formula (I) and/or the formula (II) and the compound of the formula (III) are preferably dissolved or immersed in oleophilic fine particles. The lipophilic fine particles are composed of at least one of (1) oily solvents (inclusive of those which are solid at room temperature, such as waxes) for additives, such as couplers, (2) latex polymers and (3) additives that also serve as oily solvents such as some couplers, color mixing preventing agents, ultraviolet absorbents and the like additives.

The term oleophilic fine particles refers to fine particles that are not substantially dissolved in an aqueous gelatin solution but may exist in the form of a separate phase in the aqueous gelatin solution.

In accordance with the practice of the present invention, the oleophilic fine particles are, in general, prepared by dissolving the coupler(s) of the formula (I) and/or the formula (II) and the compound of the formula (III) in a single high boiling solvent (oil) having a boiling point of 170° C. or higher under atmospheric pressure or a single low boiling solvent (in the case the oil is unnecessary, as mentioned above) or in a mixed solvent comprising said oil and said low boiling solvent, and thereafter emulsifying and dispersing the resulting solution in a hydrophilic colloidal aqueous solution such as an aqueous gelatin solution. The particle size of the oleophilic fine particles is not specifically limitative, but is preferably 0.05 to 0.5 μm, especially preferably 0.1 to 0.3 μm.

The ratio of said oil/coupler is preferably 0.00 to 2.0 by weight.

Concrete examples of the above-mentioned oils include, for example, alkyl phthalates (such as dibutyl phthalate, dioctyl phthalate, diisodecyl phthalate, dimethoxyethyl phthalate, etc.), phosphates (such as diphenyl phosphate, triphenyl phosphate, tricresyl phosphate, dioctylbutyl phosphate, monophenyl-p-t-butylphenyl phosphate, etc.), citrates (such as tributyl acetylcitrate, etc.), benzoates (such as octyl benzoate, etc.), alkylamides (such as diethyllaurylamide, dibutyllaurylamide), fatty acid esters (such as dibutoxyethyl succinate, diethyl azelate, etc.), trimesates (such as tributyl trimesate, etc.), epoxy ring-containing compounds (such as those described in U.S. Pat. No. 4,540,657, etc.), phenols (such as

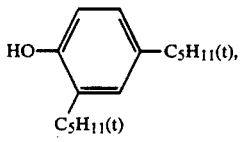

-continued

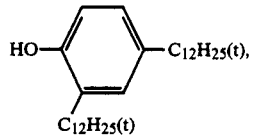

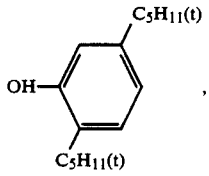

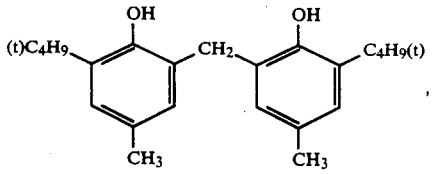

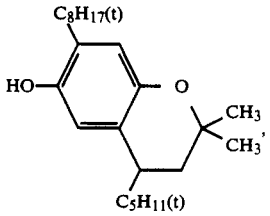

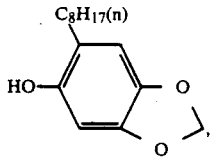

etc.), and ethers (such as phenoxyethanol, diethylene glycol monophenyl ether, etc.).

The latex polymers- which may be used in the practice of the present invention are those obtained from one or more monomers selected from acrylic acid, methacrylic acid and esters thereof (such as methyl acrylate, ethyl acrylate, butyl methacrylate, etc.), acrylamide, methacrylamide, vinyl esters (such as vinyl acetate, vinyl propionate, etc.), acrylonitrile, styrene, divinylbenzene, vinyl alkyl ethers (such as vinyl ethyl ether, etc.), maleates (such as methyl maleate, etc.), N-vinyl-2-pyrrolidone, N-vinylpyridine and 2- and 4-vinylpyridines.

The low boiling solvents to be used for the preparation of the oleophilic fine particles in accordance with the present invention are organic solvents having a boiling point of about 30° C. to 150° C. under atmospheric pressure, for example, including lower alkyl acetates such as ethyl acetate, isopropyl acetate and butyl acetate as well as ethyl propionate, methanol, ethanol, sec-butyl alcohol, cyclohexanol, fluorinated alcohols, methyl isobutyl ketone, β-ethoxyethyl acerate, methyl cellosolve acetate, acetone, methylacetone, acetonitrile, dioxane, dimethylformamide, dimethyl sulfoxide, chloroform, cyclohexane, etc.

The coupler of the formula (I) of the present invention is added to the emulsion layer of photographic light-sensitive materials in an amount of $1\times10^{-3}$ mol to 1 mol, preferably $5\times10^{-2}$ mol to $5\times10^{-1}$ mol, per 1 mol of the silver halide present in the layer. Two or more kinds of the couplers of the present invention may be added to the same emulsion layer.

In the practice of the present invention, cyan and yellow couplers may be used in addition to the above-mentioned magenta couplers.

Typical examples of the usable couplers are naphthol type compounds and phenol type couplers as well as ring-opened or heterocyclic ketomethylene compounds. Concrete examples of these cyan and yellow couplers which may be used in the present invention are described in the patent specifications as referred to in *Research Disclosure* (*RD*), No. 17643 (December, 1978), Item VII-D and No. 18717 (November, 1979).

The color couplers to be incorporated in the photographic light-sensitive materials are preferably nondiffusible, such as those containing a ballast group or being polymerized. In particular, 2-equivalent color couplers where the coupling active positions are substituted by releasable groups have an advantage on the reduced amount of silver to be coated, as compared to 4-equivalent couplers where the coupling active positions are hydrogen atoms. Couplers capable of forming color dyes with a pertinent diffusibility, non-coloring couplers, DIR couplers capable of releasing a development inhibitor in the coupling reaction and couplers capable of releasing a development accelerator in the coupling reaction may also be used in the present invention.

Typical examples of the yellow couplers which may be used in the present invention are oil-protected type acylacetamide couplers. Concrete examples thereof are described in, e.g., U.S. Pat. Nos. 2,407,210, 3,875,057 and 3,265,506. 2-Equivalent yellow couplers are particularly preferably used in the present invention; typical examples thereof are oxygen atom-releasing type yellow couplers as described, e.g., in U.S. Pat. Nos. 3,408,194, 3,447,928, 3,933,501 and 4,022,620; and nitrogen atom-releasing type yellow couplers as described in Japanese Patent Publication No. 10739/83, U.S. Pat. Nos. 4,401,752 and 4,326,024, *Research Disclosure*, No. 18053 (April, 1979), British Patent No. 1,425,020 and in German Patent Application (OLS) Nos. 2,219,917, 2,261,361, 2,329,587 and 2,433,812. α-Pivaloylacetanilide type couplers are good in the fastness, especially to light, of the formed dyes. On the other hand, α-benzoylacetanilide type couplers are good in the high color density of the formed dyes.

Cyan couplers which may be used in the present invention are oil-protected type naphthol or phenol couplers; typical examples thereof are naphthol type couplers as described in U.S. Pat. No. 2,474,293, preferably oxygen atom-releasing type- 2-equivalent naphthol couplers as described, e.g., in U.S. Pat. Nos. 4,052,212, 4,146,396 and 4,296,200. Examples of phenol type couplers are given, e.g., in U.S. Pat. Nos. 2,369,929, 2,801,171, 2,772,162 and 2,895,926. Cyan couplers which are fast to moisture and temperature are preferably used in the present invention, and typical examples thereof are phenol type cyan couplers having a higher alkyl group than the ethyl group in the meta-position of the phenol nucleus, as described in U.S. Pat. No. 3,772,002; 2,5-diacylamino-substituted phenol type couplers as described in U.S. Pat. Nos. 2,772,162, 3,758,308, 4,126,396, 4,334,011 and 4,327,173, German Patent Application (OLS) No. 3,329,729 and Japanese Patent Application No. 42671/83; and phenol type couplers having a 2-phenylureido group and a 5-acylamaino group, as described, e.g., in U.S. Pat. Nos. 3,446,622, 4,333,999, 4,451,559 and 4,427,767.

Regarding the incorporation of the couplers into the photographic light-sensitive materials, one or more types of couplers may be used together in the same light-sensitive layer, or otherwise, the same compound may be incorporated in two or more different layers, whereby the necessary characteristic is satisfied in the materials.

The couplers may be incorporated into the photographic materials by means of various known dispersion methods; and, for instance, typical methods are a solid dispersion method, preferably a latex dispersion method, more preferably an oil-in-water dispersion method. According to the oil-in-water dispersion method, a coupler is first dissolved in either a high boiling organic solvent having a boiling point of 175° C or higher or a so-called auxiliary solvent having a low boiling point or in a mixture of these solvents, and then the resulting solution is finely dispersed in water or in an aqueous medium such as an aqueous gelatin solution in the presence of a surfactant. Examples of the high boiling organic solvents are described, e.g., in U.S. Pat. No. 2,322,027.

The standard amount of the color coupler to be used falls within the range of 0.001 to 1 mol per 1 mol of the light-sensitive silver halide and, for example, the yellow coupler is preferably 0.01 to 0.5 mol and the cyan coupler is preferably 0.002 to 0.3 mol per 1 mol of the silver halide.

The silver halide emulsions to be used in the present invention are, in general, prepared by blending a solution of a water-soluble silver salt (such as silver nitrate) and a solution of a water-soluble halide (such as potassium bromide, sodium chloride or potassium iodide, which is used singly or in the form of a mixture thereof) in the presence of a solution of a water-soluble high molecular weight substance (such as gelatin).

The silver halide particles may have a particle constitution comprising different inner parts and surface layer parts or may comprise a multilayered constitution with an epitaxial constitution, or otherwise, may comprise a wholly uniform particle constitution. Further, the particles may be composite ones comprising a mixture of said constitutions. Regarding silver chlorobromide particles having different phases, for example, the particles may have a nucleus or single or plural layers therein which are rich in silver bromide over the average silver halide composition of the particles. On the contrary, the particles may have a nucleus or single or plural layers therein which are rich in silver chloride over the average silver halide composition of the particles.

The average particle size of the silver halide particles is preferably 0.1 μm or more to 2 μm or less, especially preferably 0.15 μm or more to 1 μm or less. (Regarding the average particle size, in the case where the particles are spherical or nearly spherical particles, the size is designated by the particle diameter, and in the case where the particles are cubic particles, the size is designated by the length of the edge thereof, and the mean value thereof is based on the proejected area of the particles.) The particle size distribution may be either broad or narrow.

So-called monodispersed silver halide emulsions may be used in the present invention. Regarding the degree of the monodispersiveness, the variation coefficient as obtained by dividing the standard deviation derived from the particle size distribution curve of silver halide particles by the average particle size thereof is preferably 15% or less, especially preferably 10% or less. In order to satisfy the desired gradation in the photographic light-sensitive materials, two or more monodispersed silver halide emulsions each having a different particle size distribution may be incorporated in the same emulsion layer or may be added to separate emulsion layers which substantially have the same color sensitivity as multilayered coating. Further, two or more kinds of multidispersed silver halide emulsions or a combination of a monodispersed emulsion and a multidispersed emulsion may be incorporated in the emulsion layer in the form of a mixture thereof or in the form provided in a multilayered coating.

The silver halide particles to be used in the present invention may be so-called regular crystals having a cubic, octahedral, dodecahedral or tetradecahedral regular crystalline form, or irregular crystals having a spherical or the like irregular crystalline form, or they may be composite particles comprising a combination of these crystalline forms. Further, the crystals may be tabular particles. In particular, emulsions may be used that contain tabular particles having an aspect ratio (ratio of length/thickness) of 5 or more, especially 8 or more, in an amount of 50% or more of the total projected area of the particles. The emulsions of the present invention may comprise a mixture of silver halide particles each having different crystalline forms. These emulsions may be surface latent image type emulsions capable of forming latent images mainly on the surface of the particles or internal latent image type emulsions capable of forming latent images mainly in the inside of the particles.

The photographic emulsions to be used in the present invention can be prepared in accordance with the methods as described in *Chimie et Photographique* (written by P. Glafkides and published by Paul Montel, 1957), *Photographic Emulsion Chemistry* (written by G. F. Duffin and published by The Focal Press, 1966), *Making and Coating Photographic Emulsion* (written by V. L. Zelikman, et al. and published by The Focal Press, 1964), etc. For instance, any off an acid method, a neutral method or an ammonia method may be adopted for the formation of the emulsions. Furthermore, to the reaction of a soluble silver salt and a soluble halide, a one side mixing method, a simultaneous mixing method or a combination thereof may be adopted. In addition, a method for the formation of silver halide particles in the presence of excess silver ions(which is a so-called reverse mixing method) may also be utilized. A conversion method may be used, where a halide is added for the formation of more hardly soluble silver halides. A so-called controlled double jet method where the pAg value in the liquid system for the formation of silver halides is kept constant may also be used, which is one embodiment of the simultaneous mixing method. According to this method, an emulsion of silver halide particles having a nearly regular crystalline form and having a nearly uniform particle size distribution may be obtained.

In the step of the formation of the silver halide particles or of the physical ripening thereof, a cadmium salt, a zinc salt, a lead salt, a thallium salt, an iridium salt or a complex thereof, a rhodium salt or a complex thereof, an iron salt or a complex thereof, etc., may be incorporated in the reaction system.

The silver halide emulsions are, after the particles are formed therein, generally physically ripened, demineralized and chemically ripened, and thereafter are coated on the substrate of photographic materials.

Known silver halide solvents (such as ammonia, Rhodankali or thioethers and thione compounds as described in U.S. Pat. No. 3,271,157 and Japanese Patent Application (OPI) Nos. 12360/76, 82408/78, 144319/78, 100717/79 and 155828/79) can be used in the steps of sedimentation, physical ripening and chemical ripening. The removal of soluble silver salts from the emulsions, after the physical ripening thereof, may be carried out by Nudel water-washing, flocculation sedimentation or ultrafiltration.

The photographic emulsions to be used in the present invention may be spectrally sensitized, if necessary, with methine dyes or the like spectral sensitizer dyes.

The photographic emulsions to be used in the present invention may optionally contain a variety of compounds in order to prevent the occurrence of fog during the manufacture of the photographic materials or during preservation or the photographic processing thereof, or to stabilize the photographic characteristic of the materials.

The photographic materials of the present invention may contain, as a color fog inhibitor or a color stain inhibitor, hydroquinone derivatives, aminophenol derivatives, amines, gallic acid derivatives, catechol derivatives, ascorbic acid derivatives, non-coloring couplers, sulfonamidophenol derivatives, etc.

The photographic materials of the present invention may contain a variety of discoloration inhibitors.

In the photographic materials of the present invention, the hydrophilic colloid layer may contain an ultraviolet absorbent.

The photographic materials of the present invention may contain one or more surfactants for various purposes of coating assistance, static charge prevention, improvement of the sliding property, emulsification and dispersion, blocking resistance and improvement of photographic characteristics (for example, development acceleration, high contrast intensification and sensitivity- intensification).

The photographic materials of the present invention may further contain, in addition to the abovementioned additives, various kinds of stabilizers, stain inhibitors, developing agents or precursors thereof, development accelerators or precursors thereof, lubricants, mordant agents, matt agents, antistatic agents, plasticizers and other various kinds of additives which are useful for photographic light-sensitive materials. Typical examples of these additives are described, e.g., in *Research Disclosure*, No. 17643 (December, 1978) and No. 18716 (November, 1979).

The present invention may be adopted to multilayer and multicolor photographic materials having at least two layers each having different spectral sensitivities on a support. Multilayer natural color photographic materials generally have at least one red-sensitive emulsion layer, at least one green-sensitive emulsion layer and at least one blue-sensitive emulsion layer on a support. The arrangement of these layers on the support may freely be selected depending upon the use of the photographic materials. Each of the emulsion layers may comprise two or more emulsion layers each having different sensitivities; or a photoinsensitive layer may be provided between or among two or more emulsion layers each having the same sensitivity.

The photographic materials of the present invention preferably have, in addition to the silver halide emulsion layers, auxiliary layers such as protective layers, intermediate layers, filter layers, antihalation layers, backing layers, etc., as the case may be.

In the practice cf the present invention, the photographic emulsion layers and other layers are coated on a variety of supports which are generally used for photographic light-sensitive materials, for example, flexible supports such as plastic films, papers or cloths, or rigid supports such as glass, ceramics or metals.

In particular, especially preferred supports among them are a baryta paper or a polyethylene-laminated paper support containing a white pigment (such as titanium oxide) in the polyethylene.

The present invention may be adopted to various kinds of photographic light-sensitive materials. Typical examples are color negative films for general use or for movies, color reversal films for slides or television, color papers, color positive films and color reversal papers. Further, the present invention may also be adopted to black-and-white photographic materials to utilize a three-color coupler admixture, as described in *Research Disclosure,* No. 17123 (July, 1978).

The color developers to be used in the development of the photographic light-sensitive materials of the present invention are preferably alkaline aqueous solutions comprising a main component of an aromatic primary amine type color developing agent. Preferred color developing agents are p-phenylenediamine type compounds, and typical examples thereof are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and sulfates, hydrochlorides or p-toluenesulfonates thereof.

The color developer generally contains, in addition to a preservative such as an alkali metal sulfite or hydroxylamine, a pH buffer such as an alkali metal carbonate, borate or phosphate; and a development inhibitor or an antifogging agent such as a bromide, an iodide, a benzimidazole compound a benzothiazole compound or a mercapto compound. In addition, the developer may further contain an organic solvent (such as benzyl alcohol, diethylene glycol, etc.) or a development accelerator such as polyethylene glycol tetraammonium salts or amines.

After the color development, the photographic emulsion layer is generally bleached. The bleaching treatment may be carried out simultaneously with a fixation treatment or separately therefrom. As the bleaching agent, polyvalent metal compounds such as compounds of iron(III), cobalt(III), chromium(VI), copper(II) and the like, peracids, quinones and nitroso compounds can be used. Typical bleaching agents which may be used in the practice of the present invention are ferricyanides; bichromates; organic complexes of iron(III) or cobalt (III), for example, with an aminopolycarboxylic acid such as ethylenediaminetetraacetic acid, diethylenetriaminepentaacetic acid, nitriIotriacetic acid, 1,3-diamino-2-propanoltetraacetic acid, etc., or with an organic acid such as citric acid, tartaric acid, malic acid, etc.; persulfates, manganates, or nitrosophenol. In particular, iron(III)/ethylenediaminetetraacetate and persulfates are especially preferred among them, because rapid processing is possible and any environmental pollution is minimal. The former iron(III)/ethylenediaminetetraacetate complex is particularly useful both in an independent bleaching solution and in a combined bleaching-fixation solution.

The bleaching solution and the bleaching-fixation solution may be used, if necessary, together with any other accelerator agents.

After the bleaching-fixation treatment or the fixation treatment, the photographic materials of the present invention are generally water-washed. In the washing step, various kinds of known compounds may be added to the washing bath for the purpose of preventing sedimentation of deposits or of economization of the amount of water to be used. In order to prevent the sedimentation of deposits in the washing step, for example, a water softener such as inorganic phosphoric acids, aminopolycarboxylic acids or organic phosphoric acids; a germicide or a fungicide to prevent the growth of various kinds of bacteria, algae and fungi; a hardener such as magnesium salts and aluminum salts; and surfactants for the prevention of drying load or unevenness can be employed. In addition, the compounds as described in L. E. West, "Water Quality Criteria" in *Photographic Science Engineering,* Vol. 6, pp. 344–359 (in 1965) may also be added. In particular, the addition of chelating agents and fungicides is effective.

In the water-washing step, a countercurrent washing by the use of two or more water tanks is generally employed for the purpose cf economization of the amount of water to be used. A stabilization treatment may be carried out in place of the washing treatment, and a typical embodiment of the stabilization treatment is a multistage countercurrent stabilization procedure as described in Japanese Patent Application (OPI) No. 8543/82. Various kinds of compounds are added to the baths in the stabilization step for the purpose of stabilizing the formed images. For instance, typical additives include various kinds of buffers to regulate the pH of the films (e.g., to the range of pH 3 to 8) such as borates, metaborates, borax, phosphates, carbonates, potassium hydroxide, sodium hydroxide, aqueous ammonia, monocarboxylic acids, dicarboxylic acids and polycarboxylic acids, which are used in the form of a mixture of a combination thereof, as well as aqueous formaldehyde solution. In addition, other additives may also be used, if necessary, including water softeners (such as inorganic phosphoric acids, aminopolycarboxylic acids, organic phosphoric acids, aminopolyphosphonic acids, phosphonocarboxylic acids), germicides (such as benzisothiazolinones, isothiazolinones, 4-thiazolinebenzimidazoles, halogenated phenols), surfactants, fluorescent whiteners and hardeners. Two or more kinds of the same or different additives may be used together.

Various kinds of ammonium salts are preferably used as a pH regulating agent for films of the photographic materials which have been processed, including ammonium chloride, ammonium nitrate, ammonium sulfate, ammonium phosphate, ammonium sulfite or ammonium thiosulfate.

The silver halide photographic materials of the present invention may contain a variety of 1-phenyl-3-pyrazolidones, if necessary, for the purpose of accelerating the color development thereof.

Typical examples of these compounds are described, e.g., in Japanese Patent Application (OPI) Nos. 64339/81, 144547/82, 211147/82, 50532/83, 50536/83, 50533/83, 50534/83, 50535/83 and 115438/83.

In the practice of the present invention, the processing solutions are used at a temperature of 10° C. to 50° C., and the development is preferably carried out at a temperature of 33° C. to 38° C. The treatment with a cobalt intensifier or a hydrogen peroxide intensifier, as described in German Patent No. 2,226,770 and U.S. Pat. No. 3,674,499, may be adopted to the photographic materials of the present invention, which is effective for the economization of the amount of silver in the materials.

In the practice of processing the photographic materials of the present invention, the processing baths may be provided with a heater, a temperature sensor, a liquid level sensor, a circulating pump, a filter, a floating lid and a squeegee.

The present invention will be explained in greater detail by reference to the following examples, which, however, are not intended to be interpreted as limiting the scope of the present invention.

EXAMPLE 1

The first layer (lowermost layer) to the seventh layer (uppermost layer) as shown in the following Table 1 were provided on a polyethylene duplex laminated paper to obtain Comparative Photographic Light-Sensitive Material (A).

TABLE 1

| Photographic Light-Sensitive Material (A) | |
|---|---|
| Seventh Layer: Protective Layer | |
| Gelatin | 1,600 mg/m$^2$ |
| Sixth Layer: UV-Absorbent Layer | |
| UV-absorbent (*a) | 200 mg/m$^2$ |
| Solvent (DBP) (*g) | 60 mg/m$^2$ |
| Gelatin | 1,000 mg/m$^2$ |
| Fifth Layer: Red-Sensitive Layer | |
| "Mixed Silver Chlorobromide" as described in the table below | 250 mg/m$^2$ |
| Cyan coupler (*d) | 400 mg/m$^2$ |
| UV-absorbent (*a) | 100 mg/m$^2$ |
| Solvent (DBP) (*g) | 240 mg/m$^2$ |
| Gelatin | 600 mg/m$^2$ |
| Fourth Layer: Color Stain Inhibitor Layer | |
| Color stain inhibitor (*b) | 200 mg/m$^2$ |
| UV-absorbent (*a) | 300 mg/m$^2$ |
| Solvent (DBP) (*g) | 60 mg/m$^2$ |
| Gelatin | 1,000 mg/m$^2$ |
| Third Layer: Green-Sensitive Layer | |
| "Mixed Silver Chlorobromide" as described in the table below | 200 mg/m$^2$ |
| Magenta coupler (Coupler (*f) as described in Japanese Patent Application (OPI) No. 104641/84) | 420 mg/m$^2$ |
| Discoloration inhibitor (*c) | 220 mg/m$^2$ |
| Solvent (tricresyl phosphate) | 250 mg/m$^2$ |
| Solvent (trioctyl phosphate) | 500 mg/m$^2$ |
| Sodium 2-sulfo-5-n-pentadecylhydroquinone | 18 mg/m$^2$ |
| Gelatin | 1,200 mg/m$^2$ |
| Second Layer: Color Stain Inhibitor Layer | |
| Color stain inhibitor (*b) | 350 mg/m$^2$ |
| Solvent (DBP) (*g) | 100 mg/m$^2$ |
| Gelatin | 1,000 mg/m$^2$ |
| First Layer: Blue-Sensitive Layer | |
| "Mixed Silver Chlorobromide" as described the the table below | 400 mg/m$^2$ |
| Yellow coupler (*e) | 690 mg/m$^2$ |
| Solvent (DBP) (*g) | 500 mg/m$^2$ |
| Gelatin | 1,200 mg/m$^2$ |
| Support | |
| Polyethylene duplex laminated paper support | |

| Mixed Silver Chlorobromide | | Mean Grain Size (γ) Measured by Projected Area Method (μ) | Coefficient of Variation (S*/γ) | Mixed Ratio (by weight) | Silver Bromide Content (mol %) |
|---|---|---|---|---|---|
| First Layer | Em 1 | 1 | 0.08 | 1/1 | 80 |
| | Em 2 | 0.75 | 0.07 | | 80 |
| Third Layer | Em 3 | 0.5 | 0.09 | 3/7 | 70 |
| | Em 4 | 0.4 | 0.10 | | 70 |
| Fifth Layer | Em 5 | 0.5 | 0.09 | 3/7 | 70 |
| | Em 6 | 0.4 | 0.10 | | 70 |

*: S stands for statistic standard deviation.

Notes:

(*a): Mixture of the following Compounds (A), (B), (C) (1:5:3 by molar ratio)

(A):

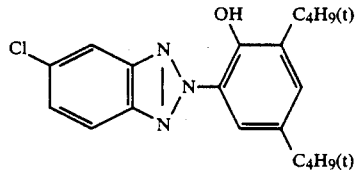

(B):

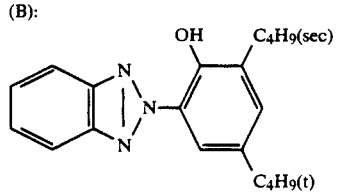

(C):

-continued

| Mixed Silver Chlorobromide | Mean Grain Size (γ) Measured by Projected Area Method (μ) | Coefficient of Variation (S*/γ) | Mixed Ratio (by weight) | Silver Bromide Content (mol %) |
|---|---|---|---|---|

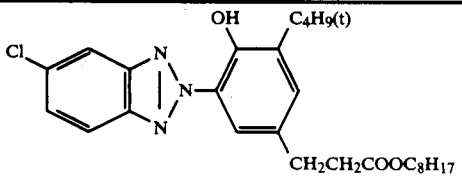

(*b): 2,5-Dioctylhydroquinone (*c): 3,3,3',3'-tetramethyl-5,6,5',6'-tetrapropyloxy-bis-1,1'-spiroindan (*d): Mixture of the following Compounds (D), (E) (1:1 by molar ratio)

(D):

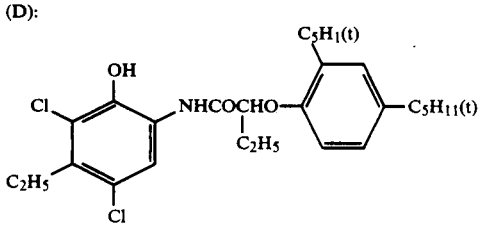

(E):

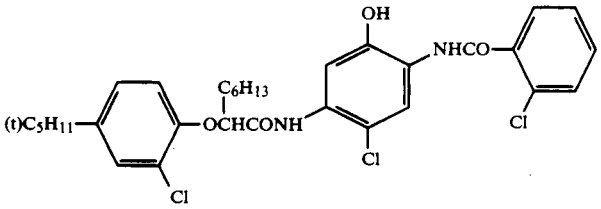

(*e):

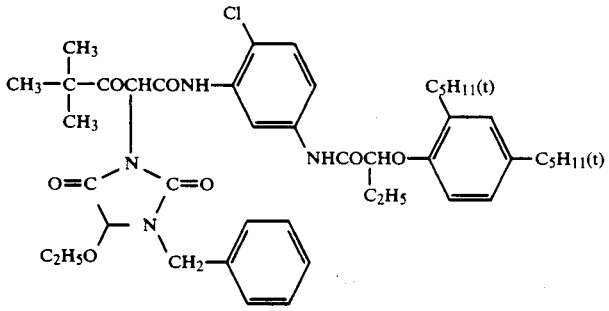

(*f):

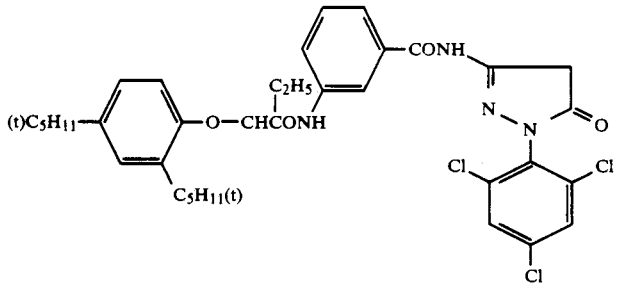

(*g): DBP = Dibutyl Phthalate

Next, the following Photographic Light-Sensitive Materials (B) through (W) (which were comparative Photographic Light-Sensitive Material (B) (Comparison)

This was the same as the above-mentioned Sample (A) with the exception that Compound (III-1) (as listed hereinbefore) was further incorporated in the third layer of Sample (A) in an amount of 30 mol % of the coupler therein.

Photographic Light-Sensitive Material (C) (Comparison)

This was the same as Sample (A) with the exception that Compound (III-12) (as listed hereinbefore) was further incorporated in the third layer of Sample (A) in an amount of 30 mol % of the coupler therein.

Photographic Light-Sensitive Material (D) (Comparison)

This was the same as Sample (A) with the exception that the third layer of Sample (A) was replaced by the green-sensitive layer of the following Table 2:

TABLE 2

| Third Layer (green-sensitive layer) | |
|---|---|
| Silver chlorobromide emulsion (silver bromide: 70 mol %) | 180 mg(Ag)/m$^2$ |
| Magenta Coupler (I-1) | 390 mg/m$^2$ |
| Discoloration inhibitor (*c) (as defined above) | 220 mg/m$^2$ |
| Solvent (tricresyl phosphate) | 250 mg/m$^2$ |
| Solvent (trioctyl phosphate) | 500 mg/m$^2$ |
| Sodium 2-sulfo-5-n-pentadecyl-hydroquinone | 18 mg/m$^2$ |
| Gelatin | 1,200 mg/m$^2$ |

Photographic Light-Sensitive Material (E) (Invention)

This was the same as Sample (D) with the exception that Compound (III-1) (as listed hereinbefore) was further incorporated in the third layer of Sample (D) in an amount of 30 mol % of the coupler therein.

Photographic Light-Sensitive Material (F) (Invention)

This was the same as Sample (D) with the exception that Compound (III-8) (as listed hereinbefore) was further incorporated in the third layer of Sample (D) in an amount of 30 mol % of the coupler therein.

Photographic Light-Sensitive Material (G) (Invention)

This was the same as Sample (D) with the exception that Compound (III-12) (as listed hereinbefore) was further incorporated in the third layer of Sample (D) in an amount of 30 mol % of the coupler therein.

Photographic Light-Sensitive Material (H) (Invention)

This was the same as Sample (D) with the exception that Compound (III-24) (as listed hereinbefore) was further incorporated in the third layer of Sample (D) in an amount of 30 mol % of the coupler therein.

Photographic Light-Sensitive Material (I) (Comparison)

This was the same as Sample (A) with the exception that the third layer of Sample (A) was replaced by the green-sensitive layer of the following Table 3:

TABLE 3

| Third Layer (green-sensitive layer) | |
|---|---|
| Silver chlorobromide emulsion (silver bromide: 70 mol %) | 180 mg(Ag)/m$^2$ |
| Magenta Coupler (II-1) | 250 mg/m$^2$ |
| Discoloration inhibitor (*c) | 220 mg/m$^2$ |
| Solvent (tricresyl phosphate) | 150 mg/m$^2$ |
| Solvent (trioctyl phosphate) | 300 mg/m$^2$ |

TABLE 3-continued

| Third Layer (green-sensitive layer) | |
|---|---|
| Sodium 2-sulfo-5-n-pentadecyl-hydroquinone | 18 mg/m$^2$ |
| Gelatin | 1,050 mg/m$^2$ |

Photographic Light-Sensitive Material (J) (Invention)

This was the same as Sample (I) with the exception that Compound (III-1) (as listed hereinbefore) was further incorporated in the third layer of Sample (I) in an amount of 30 mol % of the coupler therein.

Photographic Light-Sensitive material (K) (Invention)

This was the same as Sample (I) with the exception that Compound (III-25) (as listed hereinbefore) was further incorporated in the third layer of Sample (I) in an amount of 30 mol % of the coupler therein.

Photographic Light-Sensitive Material (L) (Comparison)

This was the same as Sample (A) with the exception that the third layer of Sample (A) was replaced by the green-sensitive layer of the following Table 4:

TABLE 4

| Third Layer (green-sensitive layer) | |
|---|---|
| Silver chlorobromide emulsion (silver bromide: 70 mol %) | 180 mg(Ag)/m$^2$ |
| Magenta Coupler (II-5) | 380 mg/m$^2$ |
| Discoloration inhibitor (*c) | 220 mg/m$^2$ |
| Solvent (tricresyl phosphate) | 250 mg/m$^2$ |
| Solvent (trioctyl phosphate) | 500 mg/m$^2$ |
| Sodium 2-sulfo-5-n-pentadecyl-hydroquinone | 18 mg/m$^2$ |
| Gelatin | 1,200 mg/m$^2$ |

Photographic Light-Sensitive Material (M) (Invention)

This was the same as Sample (L) with the exception that Compound (III-1) (as listed hereinbefore) was further incorporated in the third layer of Sample (L) in an amount of 30 mol % of the coupler therein.

Photographic Light-Sensitive Material (N) (Invention)

This was the same as Sample (L) with the exception that Compound (III-5) (as listed hereinbefore) was further incorporated in the third layer of Sample (L) in an amount of 30 mol % of the coupler therein.

Photographic Light-Sensitive Material (O) (Invention)

This was the same as Sample (L) with the exception that Compound (III-8) (as listed hereinbefore) was further incorporated in the third layer of Sample (L) in an amount of 30 mol % of the coupler therein.

Photographic Light-Sensitive Material (P) (Invention)

This was the same as Sample (L) with the exception that Compound (III-12) (as listed hereinbefore) was further incorporated in the third layer of Sample (L) in an amount of 30 mol % of the coupler therein.

Photographic Light-Sensitive Material (Q) (Invention)

This was the same as Sample (L) with the exception that Compound (III-24) (as listed hereinbefore) was further incorporated in the third layer of Sample (L) in an amount of 30 mol % of the coupler therein.

Photographic Light-Sensitive Material (R) (Invention)

This was the same as Sample (L) with the exception that Compound (III-25) (as listed hereinbefore) was further incorporated in the third layer of Sample (L) in an amount of 30 mol % of the coupler therein.

Photographic Light-Sensitive Material (S) (Invention)

This was the same as Sample (L) with the exception that Compound (III-26) (as listed hereinbefore) was further incorporated in the third layer of Sample (L) in an amount of 30 mol % of the coupler therein.

Photographic Light-Sensitive Material (T) (Comparison)

This was the same as Sample (L) with the exception that the coupler having the following constitutional formula (R-1) (which was a comparative compound and was described in U.S. Pat. No. 3,241,967) was further incorporated in the third layer of Sample (L) in an amount of 30 mol % of the coupler therein.

(R-1):

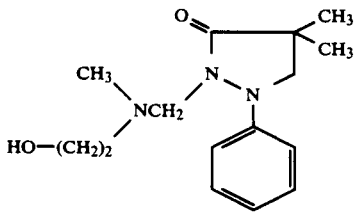

Photographic Light-Sensitive Material (U) (Comparison)

This was the same as Sample (L) with the exception that the coupler having the following constitutional formula (R-2) (which was a comparative compound and was described in Japanese Patent Application (OPI) No. 211147/82) was further incorporated in the third layer of Sample (L) in an amount of 30 mol % of the coupler therein.

(R-2):

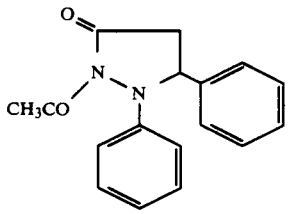

Photographic Light-Sensitive Material (V) (Comparison)

This was the same as Sample (L) with the exception that the coupler having the following constitutional formula (R-3) (which was a comparative compound and was described in Japanese Patent Application (OPI) No. 211147/82) was further incorporated in the third layer of Sample (L) in an amount of 30 mol % of the coupler therein.

(R-3):

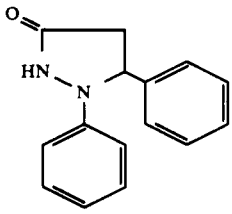

Photographic Light-Sensitive Material (W) (Comparison)

This was the same as Sample (L) with the exception that the coupler having the following constitutional formula (R-4) (which was a comparative compound and was described in Japanese Patent Application (OPI) No. 85749/81) was further incorporated in the third layer of Sample (L) in an amount of 30 mol % of the coupler therein.

(R-4):

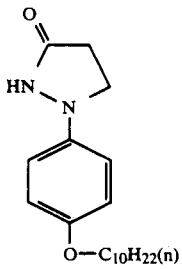

The above Samples (A) through (W) were exposed to light through an optical wedge and then color-developed in accordance with the process as described below. In the following steps, the developer and other processing solutions were so prepared that the agents in the processing solutions would easily precipitate or remain therein and that the stain would easily occur in the processes samples, in order that the effect of the present invention could definitely be clarified.

| Processing Steps | Temperature (° C.) | Time |
|---|---|---|
| Color Development | 33 | 3 min 30 sec |
| Bleaching-Fixation | 33 | 1 min 30 sec |
| Washing | 20–25 (no stirring) | 1 min |
| Drying | 50–80 | 2 min |

The composition of each processing solution was as follows:

| | |
|---|---|
| Color Developer: | |
| 3 Na Nitrilotriacetate | 2.0 g |
| Benzyl Alcohol | 15 ml |
| Diethylene Glycol | 10 ml |
| Sodium Sulfite | 0.2 g |
| Potassium Bromide | 0.5 g |
| Hydroxylamine Sulfate | 3.0 g |
| 4-Amino-3-methyl-N-ethyl-N-[β-(methanesulfonamido)ethyl]-p-phenylenediamine Sulfate | 6.5 g |
| Sodium Carbonate (monohydrate) | 30 g |
| Water to make | 1,000 ml |
| | pH 10.1 |
| Bleaching-Fixer Solution: | |
| Color Developer (as mentioned above) | 400 ml |
| Ammonium Thiosulfate (70 wt %) | 150 ml |
| Sodium Sulfite | 12 g |
| Sodium (EDTA)/Iron Complex | 36 g |
| 2 Na (EDTA) | 4 g |
| Water to make | 1,000 ml |
| 1 N Sulfuric acid to regulate pH to | 7.0 |

The above solutions were aerated for 1 hour before the actual use thereof. Regarding the composition of the above-mentioned bleaching-fixer solution, this was prepared on the assumption of a bad condition that a large amount of the color developer which adhered to the photographic light-sensitive material during the running state of the processing of the material was brought into the bleaching-fixation bath together with the material whereby the composition of the bleaching-fixer solution was changed to contain the compounds of the color developer.

After 1 hour from the development, the magenta-reflected density (stain) of the image-free part of each of Samples (A) through (W) as developed was measured with a green light of a Fuji type Automatic Recording Densitometer. On the other hand, the samples were left under the condition of 80° C. and 70% RH for 3 days and under the condition of room temperature for 50 days. The magenta-reflected density (stain) of the image-free part was measured in every sample in the same manner. The following Table 5 shows the results of these experiments, where the increment of the stain in each sample as calculated on the basis of the data obtained from the sample after 1 hour from the development thereof is given.

TABLE 5

| Sample No. | Magenta Coupler | Additive | Magenta Density: After 1 Hour | After 3 Days at 80° C., 70% RH | Increment | After 50 Days at Room Temperature | Increment |
|---|---|---|---|---|---|---|---|
| A (Comparison) | f (Comparison) | — | 0.11 | 0.21 | (0.10) | 0.12 | (0.01) |
| B (Comparison) | | (III-1) | 0.11 | 0.22 | (0.11) | 0.12 | (0.01) |
| C (Comparison) | | (III-12) | 0.11 | 0.22 | (0.11) | 0.12 | (0.01) |
| D (Comparison) | (I-1) | — | 0.20 | 0.35 | (0.15) | 0.29 | (0.09) |
| E (Invention) | | (III-1) | 0.18 | 0.26 | (0.08) | 0.26 | (0.04) |
| F (Invention) | | (III-8) | 0.17 | 0.24 | (0.07) | 0.20 | (0.03) |
| G (Invention) | | (III-12) | 0.19 | 0.26 | (0.07) | 0.22 | (0.03) |
| H (Ivention) | | (III-24) | 0.18 | 0.27 | (0.09) | 0.21 | (0.03) |
| I (Comparison) | (II-1) | — | 0.12 | 0.44 | (0.32) | 0.36 | (0.24) |
| J (Invention) | | (III-1) | 0.11 | 0.21 | (0.10) | 0.12 | (0.01) |
| K (Invention) | | (III-25) | 0.11 | 0.19 | (0.08) | 0.12 | (0.01) |
| L (Comparison) | (II-5) | — | 0.12 | 0.48 | (0.36) | 0.40 | (0.28) |
| M (Invention) | | (III-1) | 0.12 | 0.23 | (0.11) | 0.13 | (0.01) |
| N (Invention) | | (III-5) | 0.12 | 0.25 | (0.13) | 0.14 | (0.02) |
| O (Invention) | | (III-8) | 0.12 | 0.22 | (0.10) | 0.13 | (0.01) |
| P (Invention) | | (III-12) | 0.12 | 0.22 | (0.10) | 0.13 | (0.01) |
| Q (Invention) | | (III-24) | 0.12 | 0.21 | (0.09) | 0.13 | (0.01) |
| R (Invention) | | (III-25) | 0.11 | 0.21 | (0.10) | 0.13 | (0.02) |
| S (Invention) | | (III-26) | 0.12 | 0.23 | (0.11) | 0.14 | (0.02) |
| T (Comparison) | (II-5) | (R-1) (Comparison) | 0.11 | 0.43 | (0.32) | 0.38 | (0.27) |
| U (Comparison) | | (R-2) (Comparison) | 0.11 | 0.49 | (0.38) | 0.37 | (0.26) |
| V (Comparison) | | (R-3) (Comparison) | 0.12 | 0.48 | (0.36) | 0.42 | (0.30) |
| W (Comparison) | | (R-4) (Comparison) | 0.12 | 0.33 | (0.21) | 0.30 | (0.18) |

Table 5 apparently shows that the combination of the coupler of the present invention and the stain inhibitor additive of the present invention is noticeably effective for the prevention of the increment of the stains in the photographic materials after the preservation thereof. On the other hand, the 4-equivalent magenta coupler as incorporated in Comparative Samples (A) through (C) was shown to be ineffective even though this was used in combination with the stain inhibitor additive cf the present invention. Further, the comparative phenidone derivatives as incorporated in Comparative Samples (T) through (W) were shown to be substantially ineffective for the prevention of the stains. In particular, Samples (V) and (W) were noted to have been extremely desensitized because of the incorporation of said derivatives.

EXAMPLE 2

The same Photographic Light-Sensitive Material (A) as in Example 1 was prepared, and the following Photographic Light-Sensitive Materials (B) through (O) (which were comparative samples and samples of the present invention) were prepared as mentioned below:

Photographic Light-Sensitive Material (B) (Comparison)

This was the same as Sample (A) with the exception that Compound (III-1) (as listed hereinbefore) was further incorporated in the third layer of Sample (A) in an amount of 30 mol % of the coupler therein Photographic Light-Sensitive Material (C) (Comparison)

This was the same as Sample (A) with the exception that the third layer of Sample (A) was replaced by the green-sensitive layer of Table 1 of Example 1.

Photographic Light-Sensitive Material (D) (Invention)

This was the same as Sample (C) with the exception that Compound (III-1) (as listed hereinbefore) was further incorporated in the third layer cf Sample (C) in an amount of 30 mol % cf the coupler therein.

Photographic Light-Sensitive Material (E) (Invention)

This was the same as Sample (C) with the exception that Compound (III-12) (as listed hereinbefore) was further incorporated in the third layer of Sample (C) in an amount of 30 mol % of the coupler therein.

Photographic Light-Sensitive Material (F) (Invention)

This was the same as Sample (C) with the exception that Compound (III 24) (as listed hereinbefore) was further incorporated in the third layer of Sample (C) in an amount of 30 mol % of the coupler therein.

Photographic Light-Sensitive Material (G) (Comparison)

This was the same as Sample (A) with the exception that the third layer of Sample (A) was replaced by the green-sensitive layer of Table 4 of Example 1.

Photographic Light-Sensitive Material (H) (Invention)

This was the same as Sample (G) with the exception that Compound (III-1) (as listed hereinbefore) was further incorporated in the third layer of Sample (G) in an amount of 30 mol % of the coupler therein. Photographic Light-Sensitive Material (I) (Invention)

This was the same as Sample (G) with the exception that Compound (III-5) (as listed hereinbefore) was further incorporated in the third layer of Sample (G) in an amount of 30 mol % of the coupler therein.

Photographic Light-Sensitive Material (J) (Invention)

This was the same as Sample (G) with the exception that Compound (III-12) (as listed hereinbefore) was further incorporated in the third layer of Sample (G) in an amount of 30 mol % of the coupler therein.

Photographic Light-Sensitive Material (K) (Invention)

This was the same as Sample (G) with the exception that Compound (III-24) (as listed hereinbefore) was further incorporated in the third layer of Sample (G) in an amount of 30 mol % of the coupler therein.

Photographic Light-Sensitive Material (L) (Invention)

This was the same as Sample (G) with the exception that Compound (III-25) (as listed hereinbefore) was further incorporated in the third layer of Sample (G) in an amount of 30 mol % of the coupler therein.

Photographic Light-Sensitive Material (M) (Invention)

This was the same as Sample (G) with the exception that Compound (III-27) (as listed hereinbefore) was further incorporated in the third layer of Sample (G) in an amount of 30 mol % of the coupler therein.

Photographic Light-Sensitive Material (N) (Invention)

This was the same as Sample (G) with the exception that Compound (III-28) (as listed hereinbefore) was further incorporated in the third layer of Sample (G) in an amount of 30 mol % of the coupler therein.

Photographic Light-Sensitive Material (O) (Comparison)

This was the same as Sample (G) with the exception that Comparative Compound (R-1) as mentioned in Example 1 was further incorporated in the third layer of Sample (G) in an amount of 30 mol % of the coupler therein.

The above Samples (A) through (O) were exposed to light through an optical wedge and then color-developed in accordance with the process as described below.

| Processing Steps: | Temperature (° C.) | Time |
|---|---|---|
| Color Development | 33 | 3 min 30 sec |
| Bleaching-Fixation | 33 | 1 min 30 sec |
| Rinsing | 33 | 3 min |
| Drying | 50–80 | 2 min |

The composition of each processing solution was as follows:

| | |
|---|---|
| Color Developer: | |
| Benzyl Alcohol | 12 ml |
| Diethylene Glycol | 5 ml |
| Potassium Carbonate | 25 g |
| Sodium Chloride | 0.1 g |
| Sodium Bromide | 0.5 g |
| Sodium Sulfite Anhydride | 2 g |
| Hydroxylamine Sulfate | 2 g |
| Fluorescent Whitener | 1 g |
| N-Ethyl-N-β-methanesulfonamidoethyl-3-ethyl-4-aminoaniline Sulfate | 4 g |
| Water to make | 1 l |
| NaOH to regulate pH to | 10.2 |
| Bleaching-Fixer Solution: | |
| Ammonium Thiosulfate | 124.5 g |
| Sodium Metabisulfite | 13.3 g |
| Sodium Sulfite Anhydride | 2.7 g |
| Ammonium Ferric EDTA | 65 g |
| Color Developer | 100 ml |
| pH | 6.7 to 6.8 |
| Water to make | 1 l |

The development was carried out in a conventional roller transport type developing machine, whereupon the replenisher was normally fed into the processing bath and the composition of the processing solution was kept almost equilibrated.

After 1 hour from the development, the magenta-reflected density (stain) of the image-free part of each sample as developed was measured. On the other hand, the samples were kept under the condition of 80° C. and 70% RH for 3 days and under the condition of room temperature for 50 days. The magenta-reflected density (stain) of the image-free part was measured in every sample in the same manner. The following Table 6 shows the results of these experiments, where the increment of the stain in each sample as calculated on the basis of the data obtained from the sample after 1 hour from the development thereof is given.

TABLE 6

| Sample No. | Magenta Coupler | Additive | After 1 Hour | After 3 Days at 80°C., 70% RH | Increment | After 50 Days at Room Temperature | Increment |
|---|---|---|---|---|---|---|---|
| A (Comparison) | f | — | 0.11 | 0.19 | (0.08) | 0.12 | (0.01) |
| B (Comparison) | | (III-1) | 0.11 | 0.19 | (0.08) | 0.12 | (0.01) |
| C (Comparison) | (I-1) | — | 0.18 | 0.27 | (0.09) | 0.13 | (0.05) |
| D (Invention) | | (III-1) | 0.16 | 0.21 | (0.05) | 0.19 | (0.03) |
| E (Invention) | | (III-12) | 0.17 | 0.21 | (0.04) | 0.19 | (0.02) |
| F (Invention) | | (III-24) | 0.16 | 0.22 | (0.06) | 0.18 | (0.02) |
| G (Comparison) | (II-5) | — | 0.12 | 0.30 | (0.18) | 0.26 | (0.14) |
| H (Invention) | | (III-1) | 0.12 | 0.18 | (0.06) | 0.12 | (0.00) |
| I (Invention) | | (III-5) | 0.12 | 0.18 | (0.06) | 0.14 | (0.02) |
| J (Invention) | | (III-12) | 0.11 | 0.16 | (0.05) | 0.13 | (0.02) |
| K (Invention) | | (III-24) | 0.12 | 0.17 | (0.05) | 0.13 | (0.01) |
| L (Invention) | | (III-25) | 0.11 | 0.17 | (0.06) | 0.11 | (0.00) |
| M (Invention) | | (III-27) | 0.11 | 0.17 | (0.06) | 0.12 | (0.01) |
| N (Invention) | | (III-28) | 0.12 | 0.16 | (0.04) | 0.12 | (0.00) |

TABLE 6-continued

| Sample No. | Magenta Coupler | Additive | After 1 Hour | After 3 Days at 80°C., 70% RH | Increment | After 50 Days at Room Temperature | Increment |
|---|---|---|---|---|---|---|---|
| O (Comparison) | (II-5) | (R-1) | 0.11 | 0.27 | (0.16) | 0.27 | (0.16) |

Table 6 shows that the combination of the coupler of the present invention and the additive of the present invention is noticeably effective for the prevention of the increment of the stains in the photographic materials after the preservation thereof. On the other hand, the 4-equivalent magenta coupler as incorporated in Comparative Samples (A) and (B) was shown to be ineffective even though this was used in combination with the additive of the present invention. Further, the comparative phenidone derivative as incorporated in Comparative Sample (O) was substantially ineffective for the prevention cf the stains.

EXAMPLE 3

The same Photographic Light-Sensitive Materials (A) through (O) as in Example 2 were prepared, and these were exposed to light through an optical wedge and then processed in accordance with the steps as mentioned below. The samples were processed by rapid photographic processing by the use of the processing solutions as mentioned below on the assumption of the equilibrated running state in the processing steps.

| Processing Steps | Temperature (°C.) | Time* |
|---|---|---|
| Color Development | 37 | 1 min 40 sec |
| Bleaching-Fixation | 33 | 1 min 00 sec |
| Rinsing (1) | 30 | 20 sec |
| Rinsing (2) | 30 | 20 sec |
| Rinsing (3) | 30 | 20 sec |
| Drying | 80 | 1 min 00 sec |

*The time included the time for transferring the sample being processed from bath to bath.

In the rinsing steps, the water was run from the last bath (3) to the first bath (1) via the middle bath (2) in a countercurrent system.

The composition of each processing solution was as follows:

| Color Developer: | |
|---|---|
| Water | 800 ml |
| Diethylenetriaminepentaacetic Acid | 3.0 g |
| Benzyl Alcohol | 15 ml |
| Diethylene Glycol | 10 ml |
| Sodium Sulfite | 2.0 g |
| Potassium Bromide | 0.5 g |
| Potassium Carbonate | 30.0 g |
| N-Ethyl-N-(β-methanesulfonamidoethyl)-3-methyl-4-aminoaniline Sulfate | 5.5 g |
| Hydroxylamine Sulfate | 4.0 g |
| Fluorescent Whitener (stilbene type compound) | 1.0 g |
| Water to make | 1,000 ml |
| Bleaching-Fixer Solution: | |
| Ammonium Thiosulfate (70%) | 200 ml |
| Sodium Sulfite | 18 g |
| Ammonium Ethylenediaminetetraacetate/Iron(III) Complex | 65 g |
| 2 Na Ethylenediaminetetraacetate | 5 g |
| Color Developer (as mentioned above) | 350 ml |
| Water to make | 1,000 ml |
| pH | 7.00 |

After 1 hour from the development, the magenta-reflected density (stain) of the image-free part of each sample as developed was measured. On the other hand, the samples were kept under the condition of 80° C. and 70% RH for 3 days and under the condition of room temperature for 50 days. The magenta-reflected density (stain) of the image-free part was measured in every sample in the same manner. The following Table 7 shows the results of these experiments, where the increment of the stain in each sample as calculated on the basis of the data of the stain which occurred in the sample after 1 hour from the development thereof is given.

TABLE 7

| Sample No. | Magenta Coupler | Additive | After 1 Hour | After 3 Days at 80°C., 70% RH | Increment | After 50 Days at Room Temperature | Increment |
|---|---|---|---|---|---|---|---|
| A (Comparison) | f | — | 0.11 | 0.19 | (0.08) | 0.12 | (0.01) |
| B (Comparison) | f | (III-1) | 0.11 | 0.20 | (0.09) | 0.12 | (0.01) |
| C (Comparison) | (I-1) | — | 0.19 | 0.29 | (0.10) | 0.24 | (0.05) |
| D (Invention) | (I-1) | (III-1) | 0.16 | 0.22 | (0.06) | 0.19 | (0.03) |
| E (Invention) | (I-1) | (III-12) | 0.17 | 0.22 | (0.05) | 0.19 | (0.02) |
| F (Invention) | (I-1) | (III-24) | 0.17 | 0.23 | (0.06) | 0.19 | (0.02) |
| G (Comparison) | (II-5) | — | 0.12 | 0.31 | (0.19) | 0.27 | (0.15) |
| H (Invention) | (II-5) | (III-1) | 0.12 | 0.18 | (0.06) | 0.13 | (0.01) |
| I (Invention) | (II-5) | (III-5) | 0.12 | 0.18 | (0.06) | 0.14 | (0.02) |
| J (Invention) | (II-5) | (III-12) | 0.12 | 0.17 | (0.05) | 0.13 | (0.01) |
| K (Invention) | (II-5) | (III-24) | 0.12 | 0.17 | (0.05) | 0.13 | (0.01) |
| L (Invention) | (II-5) | (III-25) | 0.11 | 0.16 | (0.05) | 0.12 | (0.01) |
| M (Invention) | (II-5) | (III-27) | 0.12 | 0.18 | (0.06) | 0.13 | (0.01) |
| N (Invention) | (II-5) | (III-28) | 0.11 | 0.15 | (0.04) | 0.12 | (0.01) |
| O (Comparison) | (II-5) | (R-1) | 0.12 | 0.28 | (0.16) | 0.26 | (0.14) |

Table 7 apparently proves that the combination of the coupler of the present invention and the additive of the present invention is noticeably effective for preventing the increment of the stains in the photographic materials after the preservation thereof. On the other hand, the 4-equivalent magenta coupler as incorporated in Comparative Samples (A) and (B) was shown to be inactive even though this was used in combination with the additive of the present invention. Further, the comparative phenidone derivative as incorporated in Comparative Sample (O) was proved to be substantially ineffective for the prevention of the stains.

EXAMPLE 4

A comparative photographic light-sensitive material was prepared as mentioned below.

The first layer to the eleventh layer as mentioned below were coated on a polyethylene duplex-laminated paper support to form a multilayer color photographic light-sensitive material. The polyethylene coat as coated on one side of the support to which the first layer was applied contained a white pigment of titanium white and a slight amount of a bluish dye of ultramarine.

Compositions of Coated Photosensitive Layers

The composition of each layer as coated on the support is mentioned below. The amount of the component as coated is represented by the unit of g/m$^2$. Regarding the silver halide component, the amount is represented by the weight of the silver contained therein.

| | |
|---|---|
| First Layer: Antihalation Layer | |
| Black colloidal silver | 0.01 |
| Gelatin | 0.2 |
| Second Layer: Red-Sensitive Layer of Low Sensitivity | |
| Silver iodobromide emulsion spectrally sensitized with red-sensitizer dyes (*5 and *4) (silver iodide: 3.5 mol %, average particle size: 0.7 μm) | 0.15 (Ag) |
| Gelatin | 1.0 |
| Cyan coupler (*3) | 0.30 |
| Discoloration inhibitor (*2) | 0.15 |
| Coupler solvent (*15 and *1) | 0.06 |
| Third Layer: Red-Sensitive Layer of High Sensitivity | |
| Silver iodobromide emulsion spectrally sensitized with red-sensitizer dyes (*5 and *4) (silver iodide: 8.0 mol %, average particle size: 0.7 μm) | 0.10 (Ag) |
| Gelatin | 0.50 |
| Cyan coupler (*3) | 0.10 |
| Discoloration inhibitor (*2) | 0.05 |
| Coupler solvent (*15 and *1) | 0.02 |
| Fourth Layer: Intermediate Layer | |
| Yellow colloidal silver | 0.02 |
| Gelatin | 1.00 |
| Color stain inhibitor (*14) | 0.08 |
| Color stain inhibitor solvent (*13) | 0.16 |
| Polymer latex (*6) | 0.40 |
| Fifth Layer: Green-Sensitive Layer of Low Sensitivity | |
| Silver iodobromide emulsion spectrally sensitized with green-sensitizer dye (*12) (silver iodide: 2.5 mol %, average particle size: 0.4 μm) | 0.20 (Ag) |
| Gelatin | 0.70 |
| Magenta coupler (*11) | 0.40 |
| Discoloration Inhibitor (A) (*10) | 0.05 |
| Discoloration Inhibitor (B) (*9) | 0.05 |
| Discoloration Inhibitor (C) (*8) | 0.02 |
| Coupler solvent (*18) | 0.60 |
| Sixth Layer: Green-Sensitive Layer of High Sensitivity | |
| Silver iodobromide emulsion spectrally sensitized with green sensitizer dye (*12) (silver iodide: 3.5 mol %, average particle size: 0.9 μm) | 0.20 (Ag) |
| Gelatin | 0.70 |
| Magenta coupler (*11) | 0.40 |
| Discoloration Inhibitor (A) (*10) | 0.05 |
| Discoloration Inhibitor (B) (*9) | 0.05 |
| Discoloration Inhibitor (C) (*8) | 0.02 |
| Coupler solvent (*18) | 0.60 |
| Seventh Layer: Yellow Filter Layer | |
| Yellow colloial silver | 0.20 |
| Gelatin | 1.00 |
| Color stain inhibitor (*14) | 0.06 |
| Color stain inhibitor solvent (*13) | 0.24 |

-continued

| | |
|---|---|
| Eighth Layer: Blue-Sensitive Layer of Low Sensitivity: | |
| Silver iodobromide emulsion spectrally sensitized with blue-sensitizer dye (*16) (silver iodide: 2.5 mol %, average paricle size: 0.5 μm) | 0.15 (Ag) |
| Gelatin | 0.50 |
| Yellow coupler (*15) | 0.20 |
| Coupler solvent (*18) | 0.05 |
| Ninth Layer: Blue-Sensitive Layer of High Sensitivity | |
| Silver iodobromide emulsion spectrally sensitized with blue-sensitizer dye (*16) (silver iodide: 2.5 mol %, average particle size: 1.4 μm) | 0.20 (Ag) |
| Tenth Layer: UV Absorbent Layer | |
| Gelatin | 1.50 |
| UV absorbent (*19) | 1.0 |
| UV abosrbent solvent (*18) | 0.30 |
| Color stain inhibitor (*17) | 0.08 |
| Eleventh Layer: Protective Layer | |
| Gelatin | 1.0 |

The compounds used in the formation of the above sample are as follows:

(*1) Dioctyl phthalate (*2) 2-(2-Hydroxy-3-sec-butyl-5-t-butylphenyl)benzotrizole (*3) 2-[α-(2,4-di-t-am-ylphenoxybutanamido]-4,6-dichloro-5-ethylphenol (*4) Sodium 5,5'-dichloro-3,3'-di(3-sulfobutyl)-9-ethylthiacarbocyanine (*5) Triethylammonium 3-[2-{2-[3-(3-sulfopropyl)naphtho[1,2-d]thiazolin-2-ylidenemethyl]-1-butenyl}-3-naphtho,[1,2-d]thiazolino]propane sulfonate (*6) Polyethyl acrylate (*7) Trioctyl phosphate (*8) 2,4-Di-t-hexylhydroquinone (*9) Di(2-hydroxy-3-t-butyl-5-methylphenyl)methane (*10) 3,3,3',3'-Tetramethyl-5,6,5',6'-tetrapropoxy-1,1'-bisspiroindan (*11) 3-(2-Chloro-5-tetradecanamidoanilino)-1-(2,4,6-trichlorophenyl)-2-pyrazolidon-5-one (*12) 5,5'-Diphenyl-9-ethyl-3,3'-disulfopropyloxacarbocyanine-Na salt (*13) o-Cresyl phosphate (*14) 2,4-Di-t-octylhydroquinone (*15) α-Pivaloyl-α-[(2,4-dioxo-1-benzyl-5-ethoxhydantoin-3-yl)-2-chloro-5-(α-2,4-dioxo-t-amylphenoxy)-butanamido]acetanilide (*16) Triethylammonium 3-[2-(3-benzylrhodanin-5-ylidene)-3-benzoxazolinyl]propane sulfonate (*17) 2,4-Di-sec-octylhydroquinone (*18) Trinonyl phosphate (*19) 5-Chloro-2-(2-hydroxy-3-t-butyl-5-t-octyl)phenylbenzotriazole Next, the following Photographic Light-Sensitive Materials (B) through (N) (which were comparative samples and samples of the present invention) were prepared as follows:

Photographic Light-Sensitive Material (B)

This was the same as the above-mentioned Sample (A) with the exception that Compound (III-1) (as listed hereinbefore) was further incorporated in the fifth and sixth layers of Sample (A) each in an amount of 30 mol % of the coupler therein.

Photographic Light-Sensitive Material (C)

This was the same as Sample (A) with the exception that 0.4 g/m$^2$ of a magenta coupler of Compound (I-1) (as listed hereinbefore) and 0.6 g/m$^2$ of the coupler solvent were incorporated in the fifth and sixth layers of Sample (A).

Photographic Light-Sensitive Material (D)

This was the same as Sample (C) with the exception that Compound (III-1) (as listed hereinbefore) was further incorporated in the fifth and sixth layers of Sample (C) each in an amount of 30 mol % of the coupler therein.

Photographic Light-Sensitive Material (E)

This was the same as Sample (C) with the exception that Compound (III-12) (as listed hereinbefore) was further incorporated in the fifth and sixth layers of Sample (C) each in an amount of 30 mol % of the coupler therein.

Photographic Light-Sensitive Material (F)

This was the same as Sample (C) with the exception that Compound (III-24) (as listed hereinbefore) was further incorporated in the fifth and sixth layers of Sample (C) each in an amount of 30 mol % of the coupler therein.

Photographic Light-Sensitive Material (G)

This was the same as Sample (A) with the exception that 0.4 g/m$^2$ of a magenta coupler of Compound (II-5) (as listed hereinbefore) and 0.6 g/m$^2$ of the coupler solvent were incorporated in the fifth and sixth layers of Sample (A).

Photographic Light-Sensitive Material (H)

This was the same as Sample (G) with the exception that Compound (III-1) (as listed hereinbefore) was further incorporated in the fifth and sixth layers of Sample (G) each in an amount of 30 mol % of the coupler therein.

Photographic Light-Sensitive Material (I)

This was the same as Sample (G) with the exception that Compound (III-5) (as listed hereinbefore) was further incorporated in the fifth and sixth layers of Sample (G) each in an amount of 30 mol % of the coupler therein.

Photographic Light-Sensitive Material (J)

This was the same as Sample (A) with the exception that Compound (III-12) (as listed hereinbefore) was further incorporated in the fifth and sixth layers of Sample (A) each in an amount of 30 mol % of the coupler therein.

Photographic Light-Sensitive Material (K)

This was the same as Sample (G) with the exception that Compound (III-24) (as listed hereinbefore) was further incorporated in the fifth and sixth layers of Sample (G) each in an amount of 30 mol % of the coupler therein.

Photographic Light-Sensitive Material (L)

This was the same as Sample (G) with the exception that Compound (III-26) (as listed hereinbefore) was further incorporated in the fifth and sixth layers of Sample (G) each in an amount of 30 mol % of the coupler therein.

Photographic Light-Sensitive Material (M)

This was the same as Sample (G) with the exception that Compound (III-28) (as listed hereinbefore) was further incorporated in the fifth and sixth layers of Sample (G) each in an amount of 30 mol % of the coupler therein.

Photographic Light-Sensitive Material (N)

This was the same as Sample (L) with the exception that a comparative compound having the following constitutional formula (R-2) (which was described in Japanese Patent Application (OPI) No. 211147/82) was further incorporated in the fifth and sixth layers of Sample (L) each in an amount of 30 mol % of the coupler therein.

(R-2):

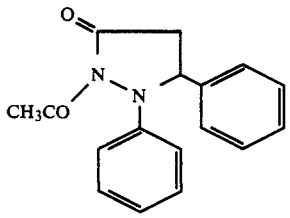

These Samples (A) through (N) thus prepared were exposed to light through an optical wedge and then color-developed in accordance with the following process.

| Processing Steps: | Temperature (°C.) | Time |
|---|---|---|
| Primary Development (black-and-white development) | 38 | 1 min 15 sec |
| Washing | 38 | 1 min 30 sec |
| Reversal Exposure (100 luxes or more) | | 1 min or more |
| Color Development | 38 | 2 min 15 sec |
| Washing | 38 | 45 sec |
| Bleaching-Fixation | 38 | 2 min 00 sec |
| Washing | 38 | 2 min 15 sec |

The composition of the processing solution as used in each step was as follows:

| | |
|---|---|
| Primary Developer Solution: | |
| Tetrasodium Nitrilo-N,N,N-trimethylene Phosphonate | 0.6 g |
| Tetrasodium Diethylenetriaminetetra-acetate | 4.0 g |
| Potassium Sulfite | 30.0 g |
| Potassium Thiocyanate | 1.2 g |
| Potassium Carbonate | 35.0 g |
| Potassium Hydroquinone Monosulfonate | 25.0 g |
| Diethylene Glycol | 15.0 ml |
| 1-Phenyl-4-hydroxymethyl-4-methyl-3-pyrazolidone | 2.0 g |
| Potassium Bromide | 0.5 g |
| Potassium Iodide | 5.0 mg |
| Water to make | 1 l |
| | pH: 9.70 |
| Color Developer Solution: | |
| Benzyl Alcohol | 15.0 ml |
| Diethylene Glycol | 12.0 ml |
| 3,6-Dithia-1,8-octanediol | 0.2 g |
| Tetrasodium Nitrilo-N,N,N-trimethylene Phosphonate | 0.5 g |
| Tetrasodium Diethylenetriaminetetra-acetate | 2.0 g |
| Sodium Sulfite | 2.0 g |
| Potassium Carbonate | 25.0 g |
| Hydroxylamine Sulfate | 3.0 g |
| N-Ethyl-N-(β-methanesulfonamidoethyl)-3-methyl-4-aminoaniline Sulfate | 5.0 g |
| Potassium Bromide | 0.5 g |
| Potassium Iodide | 1.0 mg |
| Water to make | 1 l |
| | pH: 10.40 |
| Bleaching-Fixer Solution: | |
| 2-Mercapto-1,3,4-triazole | 1.0 g |
| Disodium Ethylenediaminetetraacetate Dihydrate | 5.0 g |
| Ammonium Ethylenediaminetetraacetate/Fe(III) Complex Monohydrate | 80.0 g |
| Sodium Sulfite | 15.0 g |
| Sodium Thiosulfate (700 g/liter-solution) | 160.0 ml |

-continued

| | |
|---|---|
| Glacial Acetic Acid | 5.0 ml |
| Water to make | 1 l |
| | pH: 6.50 |

After the development, the magenta-reflected density (stain) of the image-free part of each sample as developed was measured. On the other hand, the samples were kept under the condition of 80° C. and 70% RH for 3 days and under the condition of room temperature for 80 days. The magenta-reflected density (stain) of the image-free part was measured in every sample in the same manner. The following Table 8 shows the increment of the stain in each sample as calculated on the basis of the data of the stain which occurred in the sample after 1 hour from the development thereof.

TABLE 8

| Sample No. | Magenta Coupler | Additive | Magenta Stain Increment: After 3 Days at 80° C., 70% RH | Magenta Stain Increment: After 80 Days at Room Temperature |
|---|---|---|---|---|
| A (Comparison) | f | — | 0.10 | 0.01 |
| B (Comparison) | f | (III-1) | 0.11 | 0.01 |
| C (Comparison) | (I-1) | — | 0.06 | 0.04 |
| D (Invention) | (I-1) | (III-1) | 0.03 | 0.02 |
| E (Invention) | (I-1) | (III-12) | 0.03 | 0.02 |
| F (Invention) | (I-1) | (III-24) | 0.03 | 0.02 |
| G (Comparison) | (II-5) | — | 0.13 | 0.11 |
| H (Invention) | (II-5) | (III-1) | 0.04 | 0.01 |
| I (Invention) | (II-5) | (III-5) | 0.05 | 0.00 |
| J (Invention) | (II-5) | (III-12) | 0.04 | 0.01 |
| K (Invention) | (II-5) | (III-24) | 0.03 | 0.01 |
| L (Invention) | (II-5) | (III-26) | 0.04 | 0.01 |
| M (Invention) | (II-5) | (III-28) | 0.03 | 0.01 |
| N (Comparison) | (II-5) | (R-2) | 0.15 | 0.10 |

EXAMPLE 5

A comparative photographic light sensitive material was prepared, as mentioned below.

The first layer to the eleventh layer as mentioned below were coated on a polyethylene duplex laminated paper support to form a multi-layer color photographic light sensitive material. The polyethylene coat as coated on one side of the support to which the first layer was applied contained a white pigment of titanium white and a slight amount of a blueish dye of ultramarine.

Compositions of coated photosensitive layers

The composition of each layer as coated on the support is mentioned below. The amount of the component as coated is represented by the unit of g/m$^2$. Regarding the silver halide component, the amount is represented by the weight of the silver contained therein. First layer (Gelatin layer):

| | |
|---|---|
| First layer (Gelatin layer): | |
| Gelatin | 1.30 g/m$^2$ |
| Second layer (Anti-halation layer): | |
| Black colloidal silver | 0.10 |
| Gelatin | 0.7 |
| Third layer (Red-sensitive layer of low sensitivity): | |
| Silver iodobromide emulsion spectral-sensitized with red-sensitizer dyes (*1 and *2) (Silver iodide: 5.0 mol %, Average particle size: 0.4 μm) | 0.15 (Ag) |
| Gelatin | 1.00 |
| Cyan coupler (*3) | 0.14 |
| Cyan coupler (*4) | 0.07 |
| Discoloration-inhibitor (*5 and *7) | 0.10 |
| Coupler solvent (*8 and *9) | 0.06 |
| Fourth layer (Red-sensitive layer of high sensitivity): | |
| Silver iodobromide emulsion spectral-sensitized with red-sensitizer dyes (*1 and *2) (Silver iodide: 6.0 mol %, Average particle size: 0.7 μm) | 0.15 (Ag) |
| Gelatin | 1.00 |
| Cyan coupler (*3) | 0.20 |
| Cyan coupler (*4) | 0.10 |
| Discoloration-inhibitor (*5 and *7) | 0.15 |
| Coupler solvent (*8 and *9) | 0.10 |
| Fifth layer (Intermediate layer): | |
| Black colloidal silver | 0.02 |
| Gelatin | 1.00 |
| Color stain-inhibitor (*10) | 0.08 |
| Color stain-inhibitor solvent (*11 and *12) | 0.16 |
| Polymer latex (*13) | 0.10 |
| Sixth layer (Green-sensitive layer of low sensitivity): | |
| Silver iodobromide emulsion spectral-sensitized with green-sensitizer dye (*14) (Silver iodide: 2.5 mol %, Average particle size: 0.4 μm) | 0.20 (Ag) |
| Gelatin | 0.80 |
| Magenta coupler (*15) | 0.20 |
| Discoloration-inhibitor (*16) | 0.10 |
| Stain inhibitor (*18) | 0.001 |
| Coupler solvent (*11 and *19) | 0.30 |
| Seventh layer (Green-sensitive layer of high sensitivity): | |
| Silver iodobromide emulsion spectral-sensitized with green-sensitizer dye (*14) (Silver iodide: 3.5 mol %, Average particle size: 0.9 μm) | 0.20 (Ag) |
| Gelatin | 0.80 |
| Magenta coupler (*15) | 0.20 |
| Discoloration-inhibitor (*16) | 0.10 |
| Stain inhibitor (*18) | 0.001 |
| Coupler solvent (*11 and *19) | 0.30 |
| Eighth layer (Yellow-filter layer): | |
| Yellow colloidal silver | 0.20 |
| Gelatin | 1.00 |
| Color stain-inhibitor (*10) | 0.06 |
| Color stain-inhibitor solvent (*11 and *12) | 0.15 |
| Polymer latex (*13) | 0.10 |
| Ninth layer (Blue-sensitive layer of low sensitivity): | |
| Silver iodobromide emulsion spectral-sensitized with blue-sensitizer dye (*20) (Silver iodide: 2.5 mol %, Average particle size: 0.5 μm) | 0.15 (Ag) |
| Gelatin | 0.50 |
| Yellow coupler (*21) | 0.20 |
| Stain inhibitor (*18) | 0.001 |
| Coupler solvent (*9) | 0.05 |
| Tenth layer (Blue-sensitive layer of high sensitivity): | |
| Silver iodobromide emulsion spectral-sensitized with blue-sensitizer dye (*20) (Silver iodide: 2.5 mol %, Average particle size: 1.2 μm) | 0.25 (Ag) |

-continued

| | |
|---|---|
| Yellow coupler (*21) | 0.40 |
| Stain inhibitor (*18) | 0.002 |
| Coupler solvent (*9) | 0.10 |
| Eleventh layer (UV-absorbent layer): | |
| Gelatin | 1.50 |
| UV-absorbent (*22, *6 and *7) | 1.0 |
| Color inhibitor (*23) | 0.06 |
| Color stain-inhibitor solvent (*9) | 0.15 |
| Iradiation inhibiting dye (*24) | 0.02 |
| Iradiation inhibiting dye (*25) | 0.02 |
| Twelfth layer (Protective layer): | |
| Silver chlorobromide fine particle (Silver chloride 97 mol % Average particle size: 0.2 μm) | 0.07 |
| Gelatin | 1.0 |
| Gelatin hardener (*26) | 0.17 |

The compounds used in the formation of the above sample are as follows:

(*1) Sodium 5,5'-dichloro-3,3'-di(3-sulfobutyl)-9-ethylthiacarbocyanate.

(*2) Triethylammonium 3-[2{2-[3-(3-sulfopropyl)-naphtho(1,2-d)thiazolin-2-indenemetnyl]-1-butenyl}-3-naphtho-(1,2-d)thiazolino]propansulfonate (*3) 2-[α-(2,4-di-t-amylphenoxy)butanamido]-4,6-dichloro-5-ethylphenol (*4) 2-chlorozenzoylamido]-4-chloro-5-[α-(2-chloro-4-t-amylphenoxy)octanamido]-phenol (*5) 2-(2-hydroxy-3-sec-5-t-butylphenyl)benzotiazole (*7) 2-(2-hydroxy-3,5-di-t-butylphenyl)-6-chlorobenztriazole (*8) di(2-ethylhexyl)phthalate (*9) Trinonyl phosphate (*10) 2,5-di-t-octylhydroquinone (*11) Tricresyl phosphate (*12) Dibutylphthalate (*13) Polyethyl acrylate (*14) Sodium 5,5'-diphenyl-9-ethyl-3,3'-disulfopropyloxacarbocyanate (*15) 1-(2,4,6-trichlorophenyl)-3-(2-chloro-5-tetradecane amidoanilino)-2-pyrazolin-5-on (*16) 3,3,3',3'-tetramethyl-5,6,5',6'-tetrapropoxy-1,1'-bisspiroindane (*18) 2-methyl-5-t-octylhydroquinone (*19) Trioctyl phosphate (*20) Triethylammonium 3-[2-(3-benzylrhodanin-5-iliden)-3-benzoxazonyl]propansulfonate (*21) α-pivaloyl-α-[(2,4-dioxo-1-benzyl-5-ethoxyhydantoin-3-yl)-2-chloro-5-(α-2,4-di-t-amylphenoxy) butanamido]acetanilide (*22) 5-chloro-2-(2-hydroxy-3-t-butyl-5-t-butyl-5-t-octyl) phenylbenztriazole (*23) 2,5-di-sec-octylhydroquinone (*24)

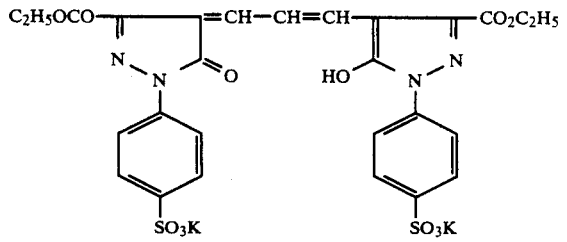

(*25)

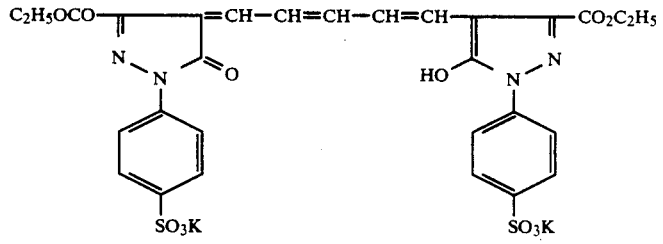

(*26) 1,2-bis(vinylsulfonylacetamido)ethane

Thus, a photographic light sensitive material (A) was prepared.

Next, the following photographic light-sensitive materials (B) through (N) (which were comparative samples and samples of the present invention) were prepared, as follows:

Photographic light-sensitive material (B)

This was the same as the above-mentioned sample (A) with the exception that the Compound (III-35) (as listed in the embodiments of compound (III)) was further incorporated in the sixth and seventh layers of the sample (A) each in an amount of 20 mole% of the coupler therein.

Photographic light-sensitive material (C)

This was the same as the sample (A) with the exception that 0.1 g/m$^2$ of a magenta coupler of the Compound (I-1) (as listed in the embodiments of compound (I)) 0.15 g/m$^2$ of the coupler solvent and 0.1 g/m$^2$ of silver iodobromide were incorporated in the sixth and seventh layers of the sample (A).

Photographic light-sensitive material (D)

This was the same as the sample (C) with the exception that the compound (III-33) (as listed in the embodiments of compound (III)) was further incorporated in the sixth and seventh layers of the sample (C) each in an amount of 20 mole% of the coupler therein.

Photographic light-sensitive material (E)

This was the same as the sample (C) with the exception that the Compound (III-35) (as listed in the embodiments of compound (III)) was further incorporated in the sixth and seventh layers of the sample (C) each in an amount of 20 mol % of the coupler therein.

Photographic light-sensitive material (F)

This was the same as the sample (C) with the exception that the Compound (III-37) (as listed in the embodiments of compound (III)) was further incorporated in the sixth and seventh layers of the sample (C) each in an amount of 20 mol % of the coupler therein.

Photographic light-sensitive material (G)

This was the same as the sample (A) with the exception that 0.1 g/m$^2$ of a magenta coupler of the Compound (II-5) (as listed in the embodiments of compound (II)) 0.15 g/m$^2$ of the coupler solvent and 0.1 g/m$^2$ of silver iodobromide were incorporated in the sixth and seventh layers of the sample (A).

Photographic light-sensitive material (H)

This was the same as the sample (C) with the exception that the Compound (III-33) (as listed in the embodiment of Compound (III)) was further incorporated in the sixth and seventh layers of the sample (G) each in an amount of 20 mol % of the coupler therein.

Photographic light-sensitive material (I)

This was the same as the sample (G) with the exception that the Compound (III-35) (as listed in the embodiment of compound (III)) was further incorporated in the sixth and seventh layers of the sample (G) each in an amount of 20 mol % of the coupler therein.

Photographic light-sensitive material (J)

This was the same as the sample (A) with the exception that the Compound (III-37) (as listed in the embodiment of compound (III)) was further incorporated in the sixth and seventh layers of the sample (A) each in an amount of 20 mol % of the coupler therein.

Photographic light-sensitive material (K)

This was the same as the sample (G) with the exception that the Compound (III-45) (as listed in the embodiment of compound (III)) was further incorporated in the sixth and seventh layers of the sample (G) each in an amount of 20 mol % of the coupler therein.

Photographic light-sensitive material (L)

This was the same as the sample (G) with the exception that the Compound (III-49) (as listed in the embodiments of compound (III)) was further incorporated in the sixth and seventh layers of the sample (G) each in an amount of 20 mol % of the coupler therein.

Photographic light-sensitive material (M)

This was the same as the sample (L) with the exception that a comparative compound having the following constitutional formula (R-2) (which was described in Japanese Patent Application (OPI) No. 211147/82) was further incorporated in the sixth and seventh layers of the sample (L) each in an amount of 20 mol % of the coupler therein (R-2):

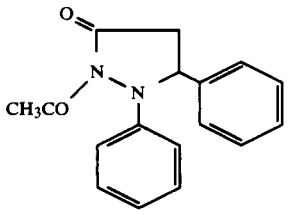

These samples (A) through (M) thus prepared were exposed to light through an optical wedge and then color-developed in accordance with the following process.

| Processing steps: | | min. sec. |
|---|---|---|
| Primary development (black-and-white development) | 38° C. | 1 15 |
| Washing | 38° C. | 1 30 |
| Reversal exposure (100 luxes or more) | | 1 or more |
| Color development | 38° C. | 2 15 |
| Washing | 38° C. | 45 |
| Bleaching-fixation | 38° C. | 2 00 |
| Washing | 38° C. | 2 15 |

The composition of the processing solution as used in each step was as follows;

| | |
|---|---|
| Primary developer solution: | |
| Tetra-sodium nitrilo-N,N,N-trimethylene-phosphonate | 0.6 g |
| Tetra-sodium diethylenetriamine-tetra-acetate | 4.0 g |
| Potassium sulfite | 30.0 g |
| Potassium thiocyanate | 1.2 g |
| Potassium carbonate | 35.0 g |
| Potassium hydroquinone-monosulfonate | 25.0 g |
| Diethylene glycol | 15.0 ml |
| 1-phenyl-4-hydroxymethyl-4-methyl-3-pyrazolidone | 2.0 g |
| Potassium bromide | 0.5 g |
| Potassium iodide | 5.0 mg |
| Water to make | 1 liter |
| | (pH 9.70) |
| Color developer solution: | |
| Benzyl alcohol | 15.0 ml |
| Diethylene glycol | 12.0 ml |
| 3,6-dithia-1,8-octane-diol | 0.2 g |
| Tetra-sodium nitrilo-N,N,N-trimethylene-phosphonate | 0.5 g |
| Tetra-sodium diethylenetriamine-tetraacetate | 2.0 g |
| Sodium sulfite | 2.0 g |
| Potassium carbonate | 25.0 g |
| Hydroxylamine sulfate | 3.0 g |
| N-ethyl-N-(β-methanesulfonamidoethyl)-3-methyl-4-aminoaniline sulfate | 5.0 g |
| Potassium bromide | 0.5 g |
| Potassium iodide | 1.0 mg |
| Water to make | 1 liter |
| | (pH 10.40) |
| Bleaching-fixer solution: | |
| 2-mercapto-1,3,4-triazole | 1.0 g |
| Disodium ethylenediamine-tetraacetate dihydrate | 5.0 g |
| Ammonium ethylenediamine-tetraacetate/Fe(III) complex mono-hydrate | 80.0 g |
| Sodium sulfite | 15.0 g |
| Sodium thiosulfate (700 g/liter-solution) | 160.0 ml |
| Glacial acetic acid | 5.0 ml |
| Water to make | 1 liter |
| | (pH 6.50) |

After the development, the magenta-reflected density (stain) of the image-free part of each sample as developed was measured. On the other hand, the samples were kept under the condition of 80° C. and 70%-RH for 3 days and under the condition of room temperature for 80 days. The magenta-reflected density (stain) of the image-free part was measured in every sample in the same manner. The following Table 9 shows the increment of the stain in each sample as calculated on the basis of the data of the stain which occurred in the sample after one hour from the development thereof.

TABLE 9

| | Samples | Coupler | Additives | Magenta-stain increment: After 3 days at 80° C., 70% RH | Magenta-stain increment: After 80 days at room temperature |
|---|---|---|---|---|---|
| A | Comparison | *15 | — | 0.10 | 0.01 |
| B | Comparison | " | III-35 | 0.10 | 0.01 |
| C | Comparison | I-1 | — | 0.06 | 0.04 |
| D | Invention | " | III-33 | 0.03 | 0.02 |
| E | Invention | " | III-35 | 0.03 | 0.02 |
| F | Invention | " | III-37 | 0.03 | 0.02 |
| G | Comparison | II-5 | — | 0.13 | 0.11 |
| H | Invention | " | III-33 | 0.04 | 0.01 |
| I | Invention | " | III-35 | 0.03 | 0.00 |
| J | Invention | " | III-37 | 0.03 | 0.01 |
| K | Invention | " | III-45 | 0.04 | 0.01 |
| L | Invention | " | III-49 | 0.05 | 0.02 |
| M | Comparison | " | R-2 | 0.14 | 0.11 |

Table 9 shows that the combination of the coupler of the present invention and the additive of the present invention is noticeably effective for the prevention of the increment of the stains in the photographic materials after preservation thereof. On the other hand, and four-equivalent magenta coupler as incorporated in the comparative samples (A) and (B) was proven to be ineffective even though this was used in combination with the additive of the present invention. Further, as seen from the results of comparative samples (G) and (M) the coupler without incorporating phenidone derivative of (III) or with incorporating a comparative phenidone derivative were proven to be substantially ineffective in prohibiting stains.

In this connection, these samples which were exposed to light through an optical wedge, were color developed in accordance with the above mentioned manner except that the alternative bleaching-fixer solution and third washing solution as mentioned below were used. The developed samples were examined in increasing a magenta reflection density (stain) and similar results to the above were obtained.

| Alternative bleaching-fixer solution | |
|---|---|
| 2-mercapto-1,3,4-triazole | 0.5 g |
| Cyclohexanediamine tetraacetate, monohydrate | 4.7 g |
| Ammonium cycloxanediamine tetraacetate/Fe(III) complex | 80.0 g |
| Sodium sulfite | 15.0 g |
| Sodium thiosulfate (700 g/liter-solution) | 160.0 ml |
| Glacial acetic acid | 5.0 ml |
| Water to make | 1 liter |
| | (pH 6.70) |
| **Third washing solution** | |
| 1-hydroxyethylidene-1,1'-diphosphonic acid (60%, w/w) | 1.6 ml |
| Bismuth chloride | 0.35 g |
| Polyvinyl pyrrolidone | 0.25 g |
| Trisodium nitrilotriacetate | 1.0 g |
| 5-chloro-2-methyl-4-isothiazolin-3-on | 50 mg |
| 2-octyl-4-isothiazolin-3-on | 50 mg |
| Fluorescent brightener (4,4'-diaminostilbene type) | 1.0 g |
| Water to make | 1 liter |
| | (pH 7.5) |

With further substituting modified third washing solution as mentioned below for the above, the developed samples were examined in increasing a magenta reflection density (stain) and similar results to the above were obtained.

Modified third washing solution

The solution was prepared with the same amount of ingredients except that a deionized water which was prepared by deionizing municipal water with Diaion SK-1B manufactured by Mitsubishi Chemical Industries Ltd. thereby containing less than 5 mg/l of calcium and magnesium ion.

Thus, the present invention is advantageous in providing silver halide color photographic materials which are almost free from stains when preserved for a long period of time after having been developed.

The invention being thus described, it will be obvious that the same may be varied in many ways. Such variations are not to be considered as a departure from the spirit and scope of the invention, and all such modifications are intended to be included within the scope of the following claims.

What is claimed is:

1. A silver halide color photographic material comprising a layer containing at least one magenta color image-forming oleophilic coupler of formula (Ib) and at least one compound of formula (III):

(Ib)

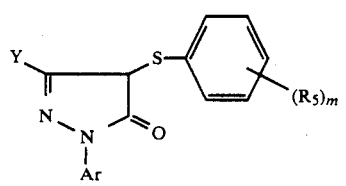

in which Ar represents a phenyl group which is substituted by at least one substituent selected from the group consisting of a halogen atom, an alkyl group, an alkoxy group, an alkoxycarbonyl group and a cyano group; $R_5$ represents a hydrogen atom, a halogen atom, an acylamino group, a sulfonamido group, a carbamoyl group, a sulfamoyl group, an alkylthio group, an alkoxycarbonyl group, a hydroxyl group, an alkyl group, an alkoxy group or an aryl group, which may optionally be substituted; m is an integer of 1 to 5 wherein when m is 2 or more, the $R_5$ groups may be the same or different; and Y represents an acylamino group or an anilino group; and (III)

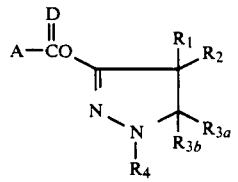

in which A represents an alkyl group, an aryl group, a heterocyclic group, an acyl group, an alkoxy group, an aryloxy group, a heterocyclic oxy group, an alkylthio group, an arylthio group or an amino group, which may be substituted or unsubstituted; $R_1$ and $R_2$ each independently represent a hydrogen atom or a substituted or unsubstituted alkyl group; $R_{3a}$ and $R_{3b}$ each represent a hydrogen atom, an alkyl group, an aryl group, an alkoxy group, an aryloxy group, an alkylthio group or an arylthio group; $R_4$ represents an alkyl group, an aryl group or a heterocyclic group; and D represents an oxygen atom or a sulfur atom.

2. The silver halide color photographic material as claimed in claim 1, wherein D in the formula (III) is an oxygen atom.

3. The silver halide color photographic material as claimed in claim 1, wherein A in the formula (III) represents a substituted or unsubstituted alkoxy group.

4. The silver halide color photographic material as claimed in claim 1, wherein A in the formula (III) does not contain an acid group of a carboxylic acid or a sulfonic acid.

5. The silver halide color photographic material as claimed in claim 1, wherein $R_{3b}$ in the formula (III) is an aryl group.

6. The silver halide color photographic material as claimed in claim 1, wherein the coupler of the formula (Ig) is added in an emulsion layer in an amount of $1\times10^{-3}$ mol to 1 mol per 1 mol of a silver halide.

7. The silver halide color photographic material as claimed in claim 1, wherein the compound of the formula (III) is added in an amount of 1 mole% to 200 mol % per amount of the coupler of the formula (Ib).

8. The silver halide color photographic material as claimed in claim 1, wherein the coupler of the formula (Ib) and the compound of the formula (III) are dissolved or impregnated in oleophilic fine particles.

9. The silver halide color photographic material as claimed in claim 8, wherein said compounds are dissolved or impregnated in an oily solvent, a water-insoluble and organic solvent-soluble polymer or a latex polymer.

10. The silver halide color photographic material as claimed in claim 9, wherein the ratio of said oily solvent/coupler is 0.00 to 0.2 by weight.

11. The silver halide color photographic material as claimed in claim 1, wherein the silver halide color photographic material further comprises a mono-disperse silver halide emulsion having 15% or less in a degree of a variation coefficient.

12. The silver halide color photographic material as claimed in claim 11, wherein the mono-disperse silver halide emulsion having 10% or less in a degree of a variation coefficient.

13. The silver halide color photographic material as claimed in claim 1, wherein the silver halide color photographic material further comprises silver halide emulsion layer containing tabular silver halide particles having an aspect ratio of 5 or more in an amount of 50% or more of a total projected area of the particles.

14. The silver halide color photographic material as claimed in claim 13, wherein the tabular silver halide particles have an aspect ratio of 8 or more.

15. The silver halide color photographic material as claimed in claim 8, wherein said oleophilic fine particles further contain an alkyl phthalate ester, a phosphate ester or phenols each having a boiling point of 170° C. or higher at atmospheric pressure.

* * * * *